US011623333B2

(12) United States Patent
Furusawa et al.

(10) Patent No.: US 11,623,333 B2
(45) Date of Patent: Apr. 11, 2023

(54) POWER TOOL HAVING A HAMMER MECHANISM AND A COOLING FAN

(71) Applicant: MAKITA CORPORATION, Anjo (JP)

(72) Inventors: Masanori Furusawa, Anjo (JP); Hajime Takeuchi, Anjo (JP); Yoji Inoue, Anjo (JP)

(73) Assignee: MAKITA CORPORATION, Anjo (JP)

( * ) Notice: Subject to any disclaimer, the term of this patent is extended or adjusted under 35 U.S.C. 154(b) by 0 days.

(21) Appl. No.: 17/217,233

(22) Filed: Mar. 30, 2021

(65) Prior Publication Data

US 2021/0299839 A1 Sep. 30, 2021

(30) Foreign Application Priority Data

Mar. 31, 2020 (JP) ..... JP2020-065286

(51) Int. Cl.
*B25D 11/12* (2006.01)
*B25D 17/02* (2006.01)
*B25D 17/06* (2006.01)

(52) U.S. Cl.
CPC ..... *B25D 17/02* (2013.01); *B25D 11/12* (2013.01); *B25D 17/06* (2013.01); *B25D 2211/068* (2013.01); *B25D 2250/121* (2013.01)

(58) Field of Classification Search
CPC .. B25D 17/02; B25D 17/06; B25D 2211/068; B25D 2250/121
USPC ..... 173/90
See application file for complete search history.

(56) References Cited

U.S. PATENT DOCUMENTS 2,974,984 A * 3/1961 Koch ..... B63H 1/20 403/230
3,119,274 A * 1/1964 Harold ..... B25D 11/106 173/48
3,136,001 A * 6/1964 Gelbard ..... B29D 99/0025 249/142
3,302,047 A * 1/1967 Short ..... H02K 9/06 310/60 R
3,829,722 A * 8/1974 Rosenthal, Jr. ..... H02K 5/08 415/217.1
3,866,314 A * 2/1975 Stone ..... H02K 9/00 29/736

(Continued)

FOREIGN PATENT DOCUMENTS

JP 2018079557 A 5/2018

*Primary Examiner* — Thomas M Wittenschlaeger
*Assistant Examiner* — David G Shutty
(74) *Attorney, Agent, or Firm* — J-Tek Law PLLC; Jeffrey D. Tekanic; Scott T. Wakeman

(57) ABSTRACT

A power tool includes a hammer mechanism, a brushless motor and a cooling fan. The brushless motor includes a rotary member having a motor shaft operably coupled to the hammer mechanism for linearly driving a tool accessory. The cooling fan has a first blade part and is configured to be rotated by the rotary member. The cooling fan includes a polymer portion, which forms at least a portion of the first blade part, and a metal portion disposed in or on the polymer portion. When viewed in a direction parallel to a rotational axis of the cooling fan, the metal member at least partially overlaps the first blade part in a radial direction of the cooling fan.

18 Claims, 11 Drawing Sheets

(56) References Cited

U.S. PATENT DOCUMENTS 3,890,061 A * 6/1975 Nechay ..... F04D 29/263 416/134 R
3,906,266 A * 9/1975 Cowman ..... B23Q 1/0009 310/74
3,952,712 A * 4/1976 Hermanson ..... F01P 5/02 416/185
4,423,345 A * 12/1983 Nilsson ..... H02K 15/03 310/156.31
4,436,163 A * 3/1984 Simpson ..... A01G 3/053 411/234
4,709,669 A * 12/1987 Wissmann ..... F02P 1/02 123/149 D
5,375,637 A * 12/1994 Matsumoto ..... B27C 5/10 310/74
5,755,194 A * 5/1998 Moorman ..... F02B 63/02 123/196 W
5,927,949 A * 7/1999 Ogasawara ..... F04D 29/023 416/241 A
6,123,158 A * 9/2000 Steffen ..... H02K 11/33 173/217
6,866,105 B2 * 3/2005 Pfisterer ..... B25F 5/008 173/217
7,168,923 B2 * 1/2007 Vasilescu ..... F04D 29/282 416/185
7,859,124 B2 * 12/2010 Maier ..... F02N 11/04 290/11
8,997,545 B1 * 4/2015 Lundquist ..... B23P 9/04 72/705
10,476,350 B2 * 11/2019 Hessenberger ..... B25F 5/006
10,836,027 B2 * 11/2020 Yang ..... B24B 23/028
11,389,940 B2 * 7/2022 Roehm ..... B25F 5/001
2004/0245879 A1 * 12/2004 Hirzel ..... H02K 21/24 310/156.01
2004/0253126 A1 * 12/2004 Cheng ..... F04D 29/023 417/423.1
2005/0008483 A1 * 1/2005 Braun ..... F04D 29/305 415/206
2005/0046191 A1 * 3/2005 Cole ..... H02K 11/05 123/41.31
2005/0196273 A1 * 9/2005 Nishikawa ..... H02K 9/06 415/206
2006/0022540 A1 * 2/2006 Leufen ..... H02K 21/14 310/156.08
2006/0280623 A1 * 12/2006 Yu ..... F04D 29/329 417/354
2012/0279736 A1 * 11/2012 Tanimoto ..... B25B 21/026 173/117
2012/0318553 A1 * 12/2012 Chen ..... B23Q 11/0046 173/198
2013/0081296 A1 * 4/2013 Catauro ..... F04D 29/666 34/130
2013/0259667 A1 * 10/2013 Huang ..... F04D 25/06 415/185
2013/0333910 A1 * 12/2013 Tanimoto ..... B25B 23/1475 173/176
2014/0368067 A1 * 12/2014 Kaizu ..... H02K 9/06 310/62
2015/0022125 A1 * 1/2015 Takano ..... H02P 29/68 318/139
2015/0151422 A1 * 6/2015 Kuehne ..... B24B 55/10 451/344
2016/0211723 A1 * 7/2016 Davidson ..... H02K 11/30
2016/0230813 A1 * 8/2016 Griffiths ..... F04C 2/084
2017/0246735 A1 * 8/2017 Hashimoto ..... H02K 11/33
2018/0030996 A1 * 2/2018 Schilling ..... F01P 5/02
2018/0126534 A1 * 5/2018 Iida ..... B25D 11/12
2018/0154507 A1 * 6/2018 Roehm ..... B25F 5/008
2018/0262094 A1 * 9/2018 Blankemeier ..... H02K 49/106
2018/0297179 A1 * 10/2018 Osada ..... B25B 21/008
2019/0190339 A1 * 6/2019 Lin ..... F04D 25/0653
2021/0402583 A1 * 12/2021 Schallert ..... B25D 11/125

* cited by examiner

FIG. 5

| | | | | | | | | | | | | | | | | | | | | |
|---|---|---|---|---|---|---|---|---|---|---|---|---|---|---|---|---|---|---|---|---|
| Rotary hammer | | HR1 | HR2 | HR3 | HR4 | HR5 | | | | HR6 | HR7 | | | | | | | | | |
| | Motor | BR | BR | BL | BR | BL | | | | BR | BL | | | | | | | | | |
| | Weight | None | None | None | None | None | | Added | | None | None | Added | | | | | | | | |
| | Moment of inertia [kg·m$^2$] | 6.11 $\times 10^{-5}$ | 8.04 $\times 10^{-5}$ | 1.03 $\times 10^{-4}$ (BL type1) | 1.83 $\times 10^{-4}$ | 1.25 $\times 10^{-4}$ (BL type1)<br>1.73 $\times 10^{-4}$ (BL type2) | | 1.72 $\times 10^{-4}$ (BL type1) | | 2.64 $\times 10^{-4}$ | 1.74 $\times 10^{-4}$ (BL type2) | 2.28 $\times 10^{-4}$ (BL type2) | | | | | | | | |
| | Impact energy[J] | 5.7 | 8.0 | 8.0 | 9.4 | 9.4 | | 9.4 | | 20 | 20 | | | | | | | | | |
| | Fan diameter [mm] | 65 | 76 | 64 | 90 | 90 | | 90 | | 90 | 90 | | | | | | | | | |
| | Mass of cooling fan (Mass of weight)[g] | 21.4 | 41.3 | 17.4 | 47.5 | 47.5 | | 132.6 (92.4) | (BL type1) | 47.5 | 38.8 | 140.3 (101.5) | | | | | | | | |
| | Mass of rotary member [g] | 364 | 429 | 346 | 684 | 346<br>524 | (BLtype1)<br>(BLtype2) | 346 | (BLtype1) | 920 | 524 | | | | | | | | | |
| Hammer | | | HM2 | HM3 | HM4 | HM5 | | | | HM6 | HM7 | | HM8 | HM9 | | HM10 | | | | |
| | Motor | | BR | BL | BR | BL | | | | BR | BL | | BR | BL | | BR | | | | |
| | Weight | | None | None | None | None | | Added | | None | None | Added | None | None | Added | None | | | | |
| | Moment of inertia [kg·m$^2$] | | 9.04 $\times 10^{-5}$ | 9.96 $\times 10^{-5}$ (BL type1) | 1.63 $\times 10^{-4}$ | 1.22 $\times 10^{-4}$ (BL type1)<br>1.70 $\times 10^{-4}$ (BL type2) | | 1.69 $\times 10^{-4}$ (BL type1) | | 2.56 $\times 10^{-4}$ | 1.68 $\times 10^{-4}$ (BL type2) | 2.41 $\times 10^{-4}$ (BL type2) | 2.77 $\times 10^{-4}$ | 1.68 $\times 10^{-4}$ (BL type2) | 2.72 $\times 10^{-4}$ (BL type2) | 4.84 $\times 10^{-4}$ | | | | |
| | Impact energy[J] | | 8.1 | 8.5 | 11.2 | 11.2 | | 11.2 | | 18.6 | 20 | | 25 | 25 | | 72.8 | | | | |
| | Fan diameter [mm] | | 76 | 64 | 80 | 80 | | 80 | | 80 | 80 | | 80 | 80 | | 90 | | | | |
| | Mass of cooling fan (Mass of weight)[g] | | 31.8 | 17.4 | 37.3 | 47.5 | | 114.6 (74.5) | (BL type1) | 30.9 | 31.6 | 154.9 (123.3) | 30.9 | 30.9 | 179.4 (147.8) | 33.1 | | | | |
| | Mass of rotary member [g] | | 451 | 346 | 664 | 346<br>524 | (BLtype1)<br>(BLtype2) | 346 | (BLtype1) | 926 | 524 | | 1001 | 524 | | 1921 | | | | |

FIG.6

[HR7]

| | Moment of inertia [kg·m$^2$] | Impact energy [J] | Load current [A] | |
|---|---|---|---|---|
| | | | Tool accessory A | Tool accessory B |
| Weight : Added | $2.9 \times 10^{-4}$ | 20 | 18.1 | 18.1 |
| | $2.5 \times 10^{-4}$ | | 17.4 | 18.1 |
| | $2.1 \times 10^{-4}$ | | 19.1 | 18.2 |
| Weight : None | $1.7 \times 10^{-4}$ | 20 | 19.3 | 19.4 |

FIG.7

[HM7]

| | Moment of inertia [kg·m$^2$] | Impact energy [J] | Load current [A] | |
|---|---|---|---|---|
| | | | Tool accessory A | Tool accessory B |
| Weight : Added | $2.7 \times 10^{-4}$ | 20 | 17.6 | 19.6 |
| | $2.4 \times 10^{-4}$ | | 16.0 | 18.6 |
| | $2.0 \times 10^{-4}$ | | 17.0 | 19.8 |
| Weight : None | $1.6 \times 10^{-4}$ | 20 | 18.0 | 19.9 |

POWER TOOL HAVING A HAMMER MECHANISM AND A COOLING FAN

CROSS-REFERENCE TO RELATED APPLICATION

The present application claims priority to Japanese patent application No. 2020-065286 filed on Mar. 31, 2020, the contents of which are hereby fully incorporated herein by reference.

TECHNICAL FIELD

The present disclosure relates to a power tool having a hammer mechanism that is configured to drive a tool accessory.

BACKGROUND

It is known to use a brushless motor in a power tool to provide, as compared with using a commutator motor (hereinafter also referred to as a brushed motor), the advantages of eliminating the need for brush replacement, reducing the size and weight of the motor itself (while maintaining the same output) and increasing the energy conversion efficiency.

SUMMARY

In one aspect of the present disclosure, a power tool includes a hammer mechanism and is configured to drive a tool accessory. The power tool further includes a brushless motor and a cooling fan. The brushless motor has a rotary member that includes a rotor and a motor shaft. The brushless motor is configured to drive the tool accessory by inputting a rotational force of the rotary member to the hammer mechanism and thereby generating a reciprocating motion. The cooling fan includes a first blade part that has a plurality of blades. The cooling fan is configured to be rotated by the rotary member. The cooling fan includes a resin (polymer) member and a metal member. The resin member includes or forms at least a portion of the first blade part. When viewed in a direction parallel to a rotational axis of the cooling fan, the metal member at least partially overlaps the first blade part (i.e. the blades) in a radial direction of the cooling fan.

In the above-described aspect, it has been found that, by placing an additional weight (metal member, which may function as a flywheel) on the polymer portion of the cooling fan, thereby increasing the moment of inertia of the cooling fan, the average load current required to drive a brushless motor to achieve a particular impact energy can be reduced, even though the overall mass of the cooling fan is increased. That is, despite the fact that the brushless motor must rotationally drive a heavier cooling fan, energy savings during a hammering operation can be achieved in a power tool having a hammer mechanism.

BRIEF DESCRIPTION OF THE DRAWINGS

FIG. 5 is a table showing the moments of inertia and the impact energies for a plurality of differently configured rotary hammers and hammers.

FIG. 6 is a table showing the average load currents of differently configured rotary hammers.

FIG. 7 is a table showing the average load currents of differently configured hammers (electric demolition hammers).

DETAILED DESCRIPTION OF THE EMBODIMENTS

Representative, non-limiting embodiments of the present disclosure are now described with reference to the drawings.

First Embodiment

A rotary hammer 101 according to a first embodiment is described with reference to FIGS. 1 to 7. The rotary hammer 101 is a power tool having a hammer mechanism configured to linearly reciprocally drive a tool accessory 18 coupled to a tool holder 34 along a prescribed driving axis A1 (hereinafter referred to as a hammering operation). The rotary hammer 101 is also configured to rotatably drive (rotate) the tool accessory 18 around the driving axis A1 (hereinafter referred to as a drilling operation).

Figure 1:
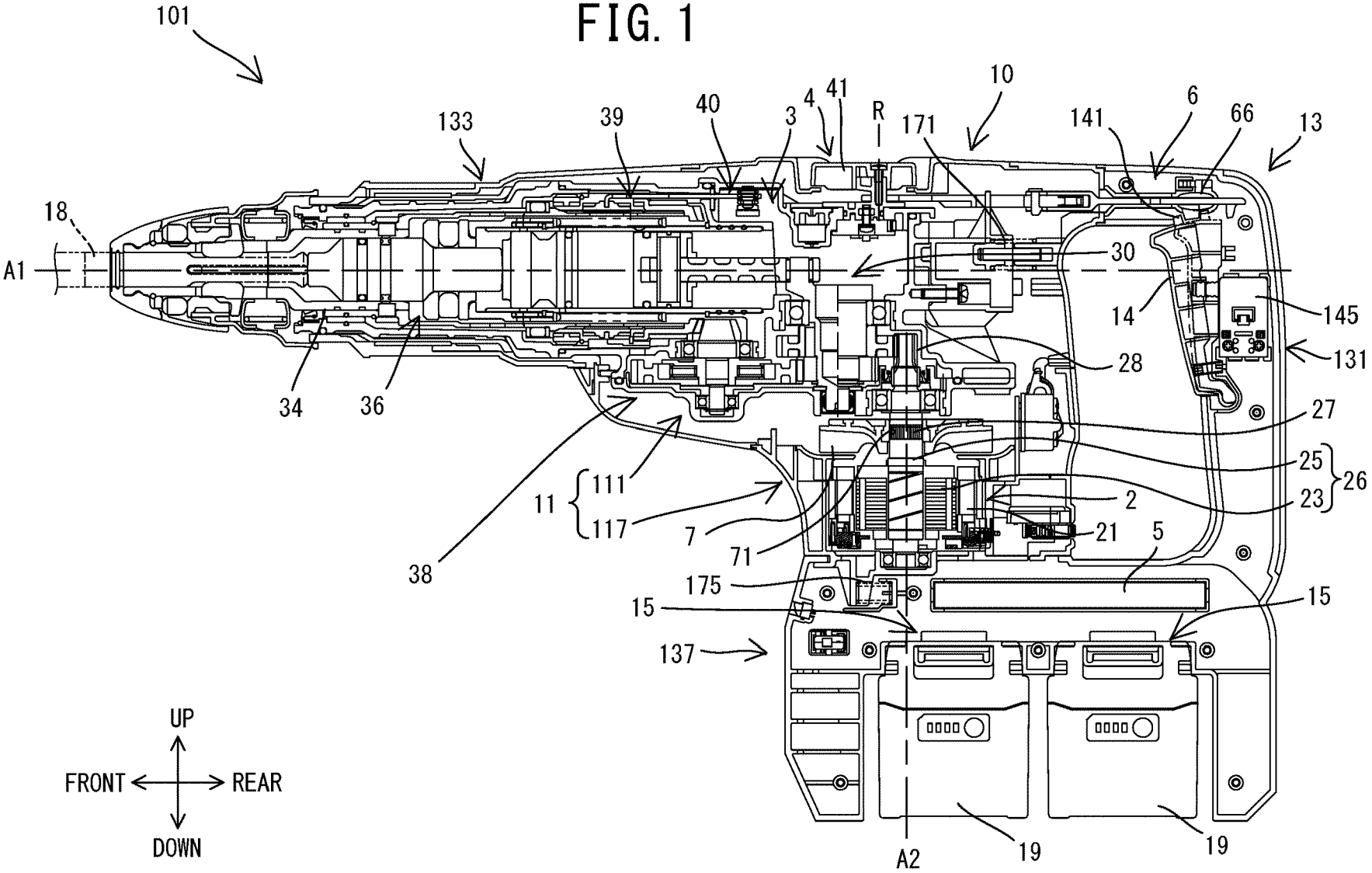
FIG. 1 is a sectional view of a rotary hammer according to the present teachings.

First, the structure of the rotary hammer 101 is described in brief with reference to FIG. 1. As shown in FIG. 1, an outer shell of the rotary hammer 101 is mainly formed by a housing 10 composed of a rigid polymer. In this embodiment, the housing 10 is configured as a vibration-isolating housing, and includes a first housing 11 and a second housing 13 that is elastically connected to the first housing 11 so as to be movable relative to the first housing 11, such as the vibration-isolating housing disclosed in US 2018/0099396, the contents of which are incorporated herein by reference.

The first housing 11 is generally L-shaped as a whole. The first housing 11 includes a motor housing part 117 for housing a motor 2 and a driving mechanism housing part 111 for housing a driving mechanism 3 configured to drive the tool accessory 18 using power (rotational energy) output by the motor 2.

The driving mechanism housing part 111 has an elongate shape and extends along the driving axis A1. The tool accessory 18 is detachably coupled to the tool holder 34, which is disposed in one longitudinal end part of the driving mechanism housing part 111. The tool accessory 18 is driven in the direction of the driving axis A1 when the motor 2 is driven; that is, the tool accessory 18 is rotated around and/or hammered in the direction of the driving axis A1. The motor housing part 117 is fixedly connected to the other longitudinal end part of the driving mechanism housing part 111. The motor housing part 117 is arranged to protrude from the driving mechanism housing part 111 in a direction crossing (intersecting) the driving axis A1 and extending away from the driving axis A1. The motor 2 is arranged such that a rotational axis A2 of a motor shaft 25 extends orthogonally to the driving axis A1. Because the direction (driving axis A1 direction) in which the tool accessory 18 is driven crosses the direction of the rotational axis A2 of the motor shaft 25, the rotary hammer 101 can be configured in a compact manner overall.

In the following description, for the sake of convenience in explanation, the extending direction of the driving axis A1 of the rotary hammer 101 (the longitudinal direction of the driving mechanism housing part 111) is defined as a front-rear direction of the rotary hammer 101. In the front-rear direction, the side of one end part of the rotary hammer 101 in which the tool holder 34 is provided is defined as the front (or the side of a front end region) of the rotary hammer 101 and the opposite side is defined as the rear of the rotary hammer 101. An extending direction of the rotational axis A2 of the motor shaft 25 is defined as an up-down direction of the rotary hammer 101. In the up-down direction, the direction in which the motor housing part 117 protrudes from the driving mechanism housing part 111 is defined as a downward direction, and the opposite direction is defined as an upward direction. Further, a direction orthogonal to the front-rear direction and the up-down direction is defined as a left-right direction.

The second housing 13 is a generally U-shaped or C-shaped hollow body as a whole (when viewed in the left-right direction), and includes a grip part (handle) 131, an upper portion 133 and a lower portion 137.

The grip part 131 is configured to be held by a user during operation of the rotary hammer 101. The grip part 131 is arranged to be spaced apart rearward from the first housing 11 and extends in the up-down direction. A trigger 14 is provided in a front part of the grip part 131 and is configured to be depressed by a finger of a user. The upper portion 133 is connected to an upper end part of the grip part 131. In this embodiment, the upper portion 133 extends forward from the upper end part of the grip part 131 and is configured to cover most of the driving mechanism housing part 111 of the first housing 11. The lower portion 137 is connected to a lower end part of the grip part 131. In this embodiment, the lower portion 137 extends forward from the lower end part of the grip part 131 and most of the lower portion 137 is disposed under the motor housing part 117. A battery mounting part 15 is provided in or on a lower, central portion of the lower portion 137 in the front-rear direction. The rotary hammer 101 is powered by one or two batteries (battery packs, battery cartridges) 19 that are removably mounted on the battery mounting part 15.

In the rotary hammer 101 having the above-described structure, both of the second housing 13 and the motor housing part 117 of the first housing 11 are exposed to the outside. The motor housing part 117 is held between the upper portion 133 and the lower portion 137 of the second housing 13 in the up-down direction. The second housing 13 and the motor housing part 117 form an outer surface of the rotary hammer 101.

The structure of the rotary hammer 101 is now described in detail.

First, the vibration-isolating structure of the housing 10 is briefly described with reference to FIG. 1. As described above, the housing 10 includes the second housing 13 (which includes the grip portion 131) that is elastically connected to the first housing 11 (which accommodates the motor 2 and the drive mechanism 3) so that the first and second housings 11, 13 are movable relative to each other, in particular in the front-rear direction.

More specifically, as shown in FIG. 1, a first elastic member 171 (e.g., a first compression coil spring) is disposed between the driving mechanism housing part 111 of the first housing part 11 and the upper portion 133 of the second housing 13. In addition, a second elastic member 175 (e.g., a second compression coil spring) is disposed between the motor housing part 117 of the first housing 11 and the lower portion 137 of the second housing 13. The first housing 11 and the second housing 13 are biased by the elastic members 171 and 175 away from each other in the extending direction of the driving axis A1, i.e. in the front-rear direction, such that the grip part 131 is biased to move in a direction away from the first housing 11 and vice versa. Specifically, the first housing 11 is biased forward relative to the second housing 13.

Further, the upper and lower portions 133, 137 are configured to be slidable relative to and along upper and lower (edge) portions of the motor housing part 117, respectively. More specifically, a lower (longitudinal edge) surface of the upper portion 133 and an upper (longitudinal edge) surface of the motor housing part 117 are in contact with and slidable relative to each other, and an upper (longitudinal edge) surface of the lower portion 137 and a lower (longitudinal edge) surface of the motor housing part 117 are in contact with and slidable relative to each other. Further, although not shown in detail, a sliding guide for guiding relative movement of the first and second housings 11, 13 in the front-rear direction is provided in the vicinity of each of the elastic members 171, 175.

Owing to the above-described vibration-isolating structure, the first and second housings 11, 13 are movable relative to each other in the front-rear direction. Thus, the largest and most dominant vibration caused in the extending direction of the driving axis A1 (the front-rear direction) in the first housing 11 during a hammering operation is effectively suppressed or dampened from being transmitted to the second housing 13.

The structures of elements disposed within the first housing 11 are now described.

As shown in FIG. 1, the motor 2 is housed in the motor housing part 117. In this embodiment, a brushless motor (brushless DC motor) is used as the motor 2. The motor 2 has a stator 21, a rotor 23, and a motor shaft 25 extending from the rotor 23 in the direction of the rotational axis A2 (the up-down direction). The motor shaft 25 is rotatably supported at its upper and lower end portions by upper and lower bearings, respectively, that are held in the motor housing part 117. The rotor 23 and the motor shaft 25 rotate together when the motor 2 is driven. In this embodiment, the rotor 23 and the motor shaft 25 are also collectively referred to as a rotary member 26. A driving gear 28 is formed on or at an upper end part of the motor shaft 25 that protrudes into the driving mechanism housing part 111.

A cooling fan 7 is fixedly connected to the motor shaft 25 so as to rotate therewith. A connection part 27 of the motor shaft 25 for connection with the cooling fan 7 has a knurled surface, preferably a linear knurled surface. The cooling fan 7 is fixedly connected to the rotary member 26 in an interference fit manner by press-fitting the motor shaft 25 into an insertion hole 71 that is formed at (in) the radial center of the cooling fan 7. The rotary member 26 and the cooling fan 7 rotate together around the rotational axis A2 when the motor 2 is driven. Specifically, the cooling fan 7 is rotated by the rotational force of the rotary member 26 of the motor 2. When the cooling fan 7 rotates, air is sucked in from (through) one or more inlets or holes (not shown) formed in the housing 10 and cools a controller 5 and the motor 2, and is then discharged from (through) one or more outlets or holes (not shown) in the housing 10. The cooling fan 7 will be described in further detail below.

The driving mechanism 3 is housed in the driving mechanism housing part 111. The driving mechanism 3 includes a motion converting mechanism 30, a striking mechanism 36 and a rotation transmitting mechanism 38. Driving mechanisms (3) having such a structure are well known and therefore the driving mechanism 3 of the first embodiment is only briefly described below.

The motion converting mechanism 30 is configured to convert rotation of the motor shaft 25 into linear motion and transmit it to the striking mechanism 36. In this embodiment, a crank mechanism including a crank shaft and a piston is used as the motion converting mechanism 30. When the motor 2 is driven and the piston is moved forward, the striking mechanism 36 transmits the kinetic energy of the piston to the tool accessory 18 via the action of an air spring, e.g., via an impact bolt (striker). Thus, the tool accessory 18 is linearly driven (hammered) forward along the driving axis A1 and axially strikes a workpiece. On the other hand, when the piston is moved rearward, the striking mechanism 36 and the tool accessory 18 return to their initial positions. By repeating these linear movements in a reciprocating manner, a hammering operation is performed by the motion converting mechanism 30 and the striking mechanism 36.

The rotation transmitting mechanism 38 is configured to transmit rotational power of the motor shaft 25 to the tool holder 34. In this embodiment, the rotation transmitting mechanism 38 is configured as a speed reducing gear mechanism that includes a plurality of gears. An engaging type clutch 39 is disposed in a power transmission path of the rotation transmitting mechanism 38. When the clutch 39 is engaged, the tool holder 34 is rotated by the rotation transmitting mechanism 38, whereby the tool accessory 18 coupled to the tool holder 34 is rotationally driven around the driving axis A1. On the other hand, when the clutch 39 is disengaged (FIG. 1 shows this state), power transmission to the tool holder 34 by the rotation transmitting mechanism 38 is interrupted, so that the tool accessory 18 is not rotationally driven.

In this embodiment, the rotary hammer 101 is configured to be selectively operated in one of two modes selected from a hammer mode (only hammering) and a hammer drill mode (rotation with hammering). That is, in the hammer mode, the clutch 39 is disengaged and only the motion converting mechanism 30 is driven, so that only the hammering operation is performed. In the hammer drill mode, the clutch 39 is engaged such that both the motion converting mechanism 30 and the rotation transmitting mechanism 38 are driven, thereby causing both the hammering operation and the drilling operation to be simultaneously performed.

The rotary hammer 101 has a mode switching dial (action mode changing knob) 4 that is configured to be operated (manually manipulated) by a user to select one of the two modes. The mode switching dial 4 is supported by (on) an upper rear end part of the first housing 11 (specifically, by (on) the driving mechanism housing part 111) so as to be rotatable around a pivot axis R extending in the up-down direction. The upper rear end part of the driving mechanism housing part 111 is covered by the upper portion 133 of the second housing 13, but a disc-like operation part 41 of the mode switching dial 4 is exposed to the outside from (through) an opening formed in the upper portion 133.

The mode switching dial 4 has two switching positions that are respectively set corresponding to the hammer mode and the hammer drill mode in a circumferential direction around the pivot axis R. Although not shown in detail, the upper portion 133 has marks respectively corresponding to the two switching positions. A user can select the desired mode by turning the operation part 41 and setting a pointer of the operation part 41 to one of the two switching positions (one of the two marks) corresponding to the desired mode. The switching positions corresponding to the hammer mode and the hammer drill mode are hereinafter referred to as a hammer position and a hammer drill position, respectively.

As shown in FIG. 1, a clutch switching mechanism 40 is provided within the driving mechanism housing part 111. The clutch switching mechanism 40 is connected to the mode switching dial 4 and is configured to switch the clutch 39 between the engaged state and the disengaged state. The clutch switching mechanism 40 disengages the clutch 39 when the mode switching dial 4 is switched to the hammer position (or when the hammer mode is selected), while engaging the clutch 39 when the mode switching dial 4 is switched to the hammer drill position (or when the hammer drill mode is selected). The structure of the clutch switching mechanism 40 is well known and therefore not described or shown in detail here.

Next, the structures of elements disposed within the second housing 13 are now described.

First, the structure of an element disposed within the upper portion 133 is described. As shown in FIG. 1, a lock mechanism 6 is disposed within a rear part of the upper portion 133. The lock mechanism 6 is configured to restrict movement of the trigger 14 in accordance with the switching position of the mode switching dial 4 (or the mode selected by the user).

Next, the structures of elements disposed within the grip part 131 are described. As shown in FIG. 1, the grip part 131 is a hollow, generally cylindrical (tubular) part extending in the up-down direction. The trigger 14 is provided in a front part of the grip part 131 and is configured to be depressed by a user. The trigger 14 is configured to be pivotable, around a pivot axis extending in the left-right direction, substantially in the front-rear direction within a prescribed pivot range. The trigger 14 is always biased forward, and is held in (at) a foremost position of the pivot range when not depressed. The trigger 14 is biased by a plunger (and/or a biasing spring) of a main switch 145. The trigger 14 can be pivoted to a rearmost position of the rotation range in response to being depressed by the user. A locking projection 141 is provided on (at) an upper end part of the trigger 14 and protrudes upward. In this embodiment, two such locking projections 141 are arranged apart from each other in the left-right direction.

The main switch 145 is provided within the grip part 131. The main switch 145 is switched between an ON state and an OFF state in response to being depressed by the trigger 14. Specifically, the main switch 145 is kept in the OFF state when the trigger 14 is held in (at) the foremost position without being depressed. When the trigger 14 is depressed and pivoted to a prescribed actuating position within the rotation range, the main switch 145 is turned ON. In this embodiment, although not shown, the rearmost position of the trigger 14 is set slightly rearward of this actuating position. The main switch 145 is turned OFF when the trigger 14 is located in (at) any position between the foremost position and the actuating position (but not including the actuating position), while being turned ON when the trigger 14 is located in (at) any position between the actuating position and the rearmost position (including the actuating position). The positions of the trigger 14 in which the main switch 145 is turned OFF are hereinafter collectively referred to as an OFF position, while the positions of the trigger 14 in which the main switch 145 is turned ON are collectively referred to as an ON position.

Next, the structures of elements disposed within the lower portion 137 are described. As shown in FIG. 1, the lower portion 137 has a rectangular box-like shape having a partially open top and is arranged under the motor housing part 117.

The controller 5 is disposed within the lower portion 137. Although not shown in detail, the controller 5 includes a control circuit, a substrate (circuit board) on which the control circuit is mounted, and a case for housing them. In this embodiment, the control circuit is configured as a microcomputer or microprocessor that includes a CPU, ROM, RAM, etc. The controller 5 (the control circuit) is electrically connected to the motor 2, the main switch 145 and the battery mounting part 15 via electrical wiring (not shown). In this embodiment, the controller 5 (the control circuit) is configured to start energization of the motor 2 (or driving of the tool accessory 18) when the trigger 14 is depressed and the main switch 145 is turned ON, and to stop energization of the motor 2 when the trigger 14 is released and the main switch 145 is turned OFF.

Further, as described above, the battery mounting part 15 is provided in or on the lower portion 137. In this embodiment, two battery mounting parts 15 are arranged side by side in the front-rear direction. Thus, two batteries (battery packs, battery cartridges) 19 can be mounted on the rotary hammer 101 at the same time. In this embodiment, the batteries 19 are rechargeable. Each of the battery mounting parts 15 has an engagement structure (e.g., rails) for sliding engagement with the battery 19, and terminals for electrical connection with the battery 19. The structure of such a battery mounting part 15 is well known and therefore not shown or described in detail.

As described above, the rotary hammer 101 is configured such that when the motor 2 is driven, the motion converting mechanism 30 converts rotation of the motor shaft 25 into linear motion and transmits it to the striking mechanism 36. Then the striking mechanism 36 transmits kinetic energy to linearly drive the tool accessory 18. The tool accessory 18 outputs the kinetic energy as impact energy to a workpiece. Specifically, in the rotary hammer 101, the kinetic energy of the motor 2 is converted into impact energy that is outputted (applied) to the tool accessory 18.

When the motor 2 of the rotary hammer 101 is driven, the rotor 23, the motor shaft 25 and the cooling fan 7 rotate together. Thus, the kinetic energies of the rotor 23, motor shaft 25 and cooling fan 7, which are all rotating, are collectively converted into impact energy by the motion converting mechanism 30. Here, it is noted that the kinetic energy (angular kinetic energy or rotational energy) of a rotating object is proportional to the multiplication product of the moment of inertia and the square of the angular speed (angular velocity) of the rotating object. Therefore, the first embodiment is designed such that the moment of inertia of the rotating cooling fan 7 is increased (as compared to conventional cooling fans used with brushless motors) in order to increase the impact energy output of the rotary hammer 101, which also has the ancillary advantageous effect of avoiding an increase of a load current of the motor 2, as will be further described below.

The structure of the cooling fan 7 of the rotary hammer 101 of the first embodiment is now described with reference to FIGS. 2 to 4.

Figure 2:
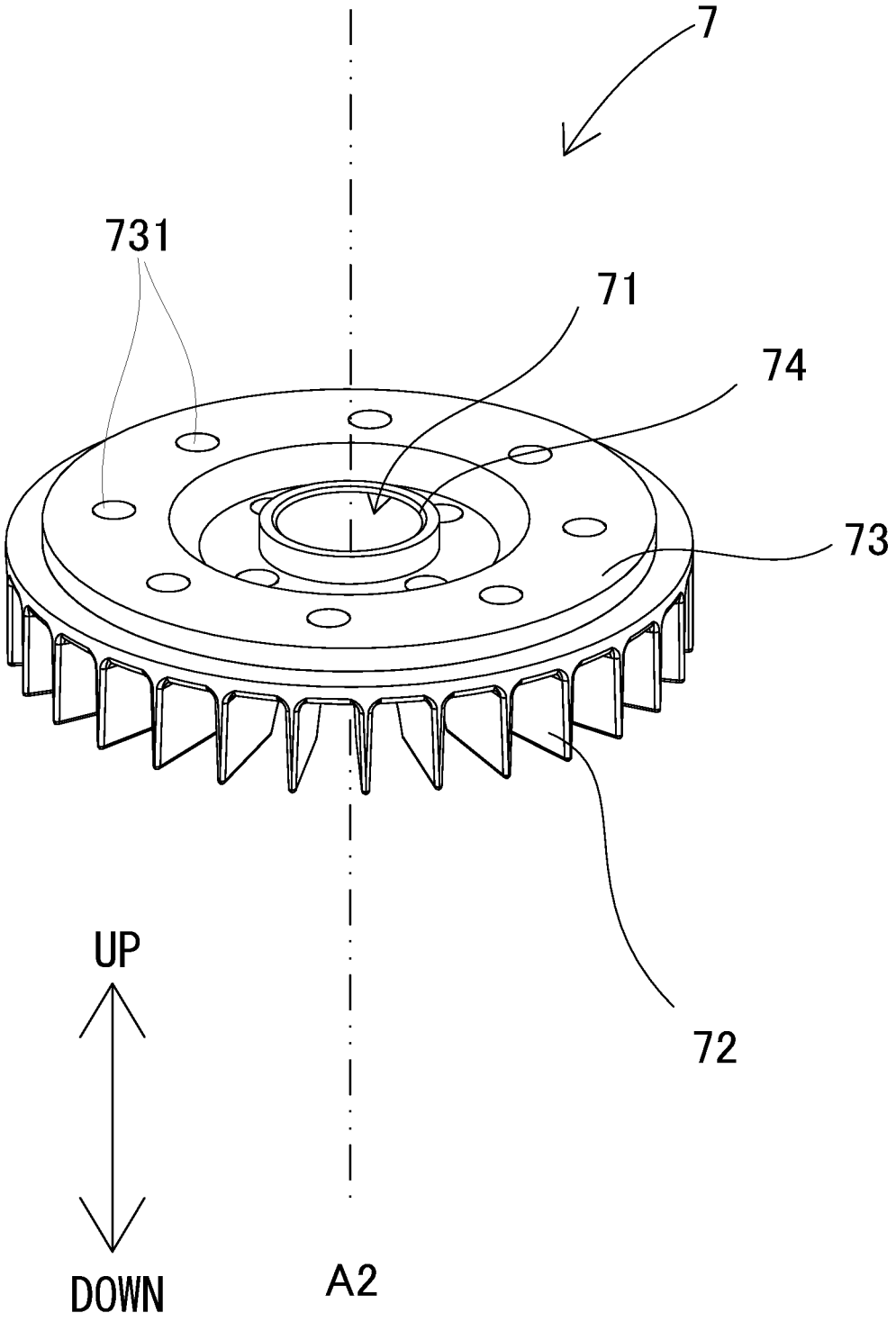
FIG. 2 is a perspective view of a cooling fan in a first embodiment of the present teachings.

As shown in FIG. 2, the cooling fan 7 has a blade part 72 and a weight 73. The blade part 72 is formed on a lower side of the cooling fan 7, and the weight 73 is formed or provided on an upper side of the cooling fan 7. The blade part 72 is a portion of a resin (polymer) member that is made of resin (polymer). In each of the embodiments, the resin or polymer may be composed, e.g., predominately of a polyamide, such as a nylon, e.g., with or without fillers such as glass or carbon fibers. The weight 73 is a substantially ring shaped (annular) or washer shaped member that is made of metal. Preferably, the weight 73 has a central hole defined by a circular inner peripheral edge, a circular outer peripheral edge and a width in the radial direction between the circular inner peripheral edge and the circular outer peripheral edge that is greater than its depth or thickness in a direction perpendicular to the radial direction (e.g., in the direction of the rotational axis A2), preferably at least two times or three times greater than its depth or thickness. The weight 73 preferably functions or acts as a flywheel that is integrally attached to the cooling fan 7 to store angular kinetic (rotational) energy. In this first embodiment, the cooling fan 7 is formed by integrally molding (insert molding) the resin member with the metal member. More specifically, the cooling fan 7 is manufactured by (i) forming the metal member 73, e.g., by casting, (ii) placing the metal member in an injection molding die and then (iii) integrally molding the resin member with the metal member (i.e. an insert in the injection molding die). Owing to the arrangement of a structure that includes the weight 73 on one side and the blade part 72 on the other side, the cooling fan 7 can be easily manufactured in a simple structure.

Further, the radially inward portion (surface or edge) of the metal member (i.e., a portion of the weight 73) forms or defines the periphery of the insertion hole 71 of the cooling fan 7. In other words, a connection part 74 of the cooling fan 7 that is designed to be connected with the rotary member 26 (the motor shaft 25; see FIG. 1) is made of a portion of the metal member 73. As described above, the cooling fan 7 is connected to the rotary member 26 by press-fitting the motor shaft 25 into the insertion hole 71 formed at (in) the radial center of the cooling fan 7. Therefore, the strength of connection between the cooling fan 7 and the motor shaft 25 is increased owing to the metal-metal contact (rather than a polymer-metal contact).

Through holes 731 are formed in the weight 73 at equal intervals in the circumferential direction of the weight 73 so that the mass of the weight 73 is balanced in the rotational direction of the cooling fan 7. When the resin member is insert-molded with (around) the metal member (weight 73), the through holes 731 are filled with resin (polymer). Therefore, the through holes 731 of the metal member (weight 73) and the portions of the resin member filled into the through holes 731 serve as anchors (or plugs) that prevent slippage of the resin member (blade part 72) relative to the metal member (weight 73) when the cooling fan 7 is rotating.

Figure 3:
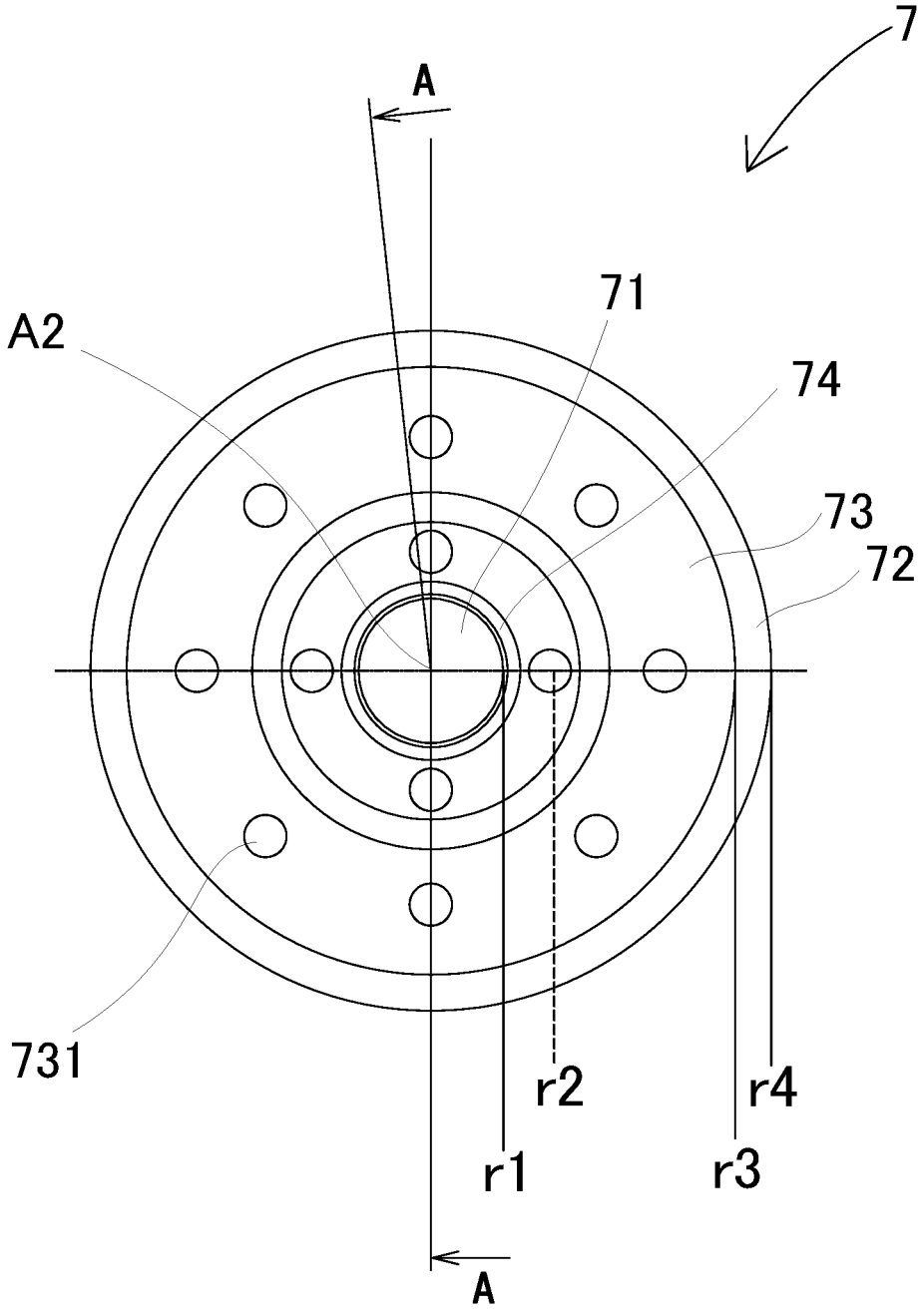
FIG. 3 is a top view of the cooling fan in the first embodiment.
Figure 4:
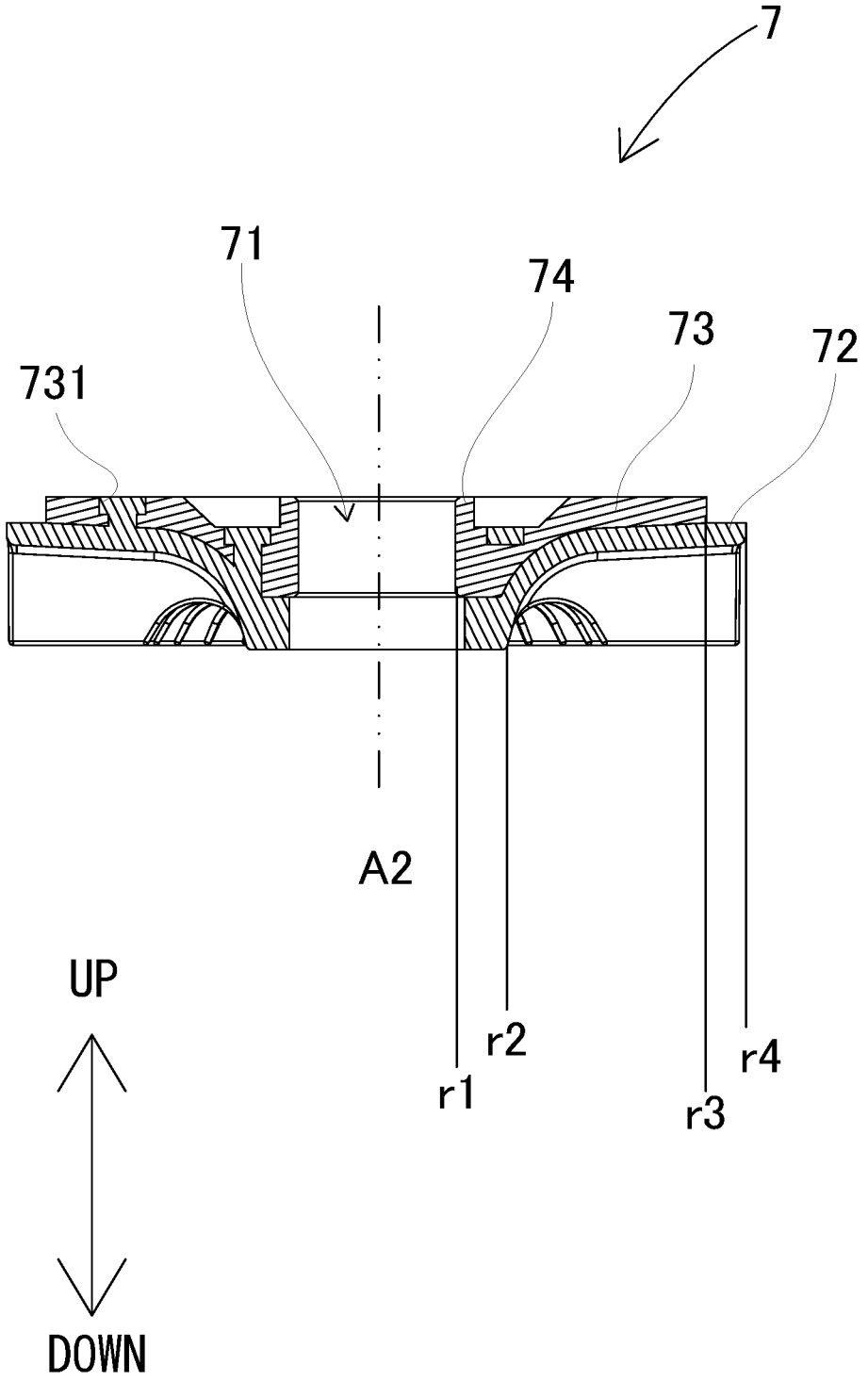
FIG. 4 is a sectional view taken along line A-A in FIG. 3.
Figure 8:
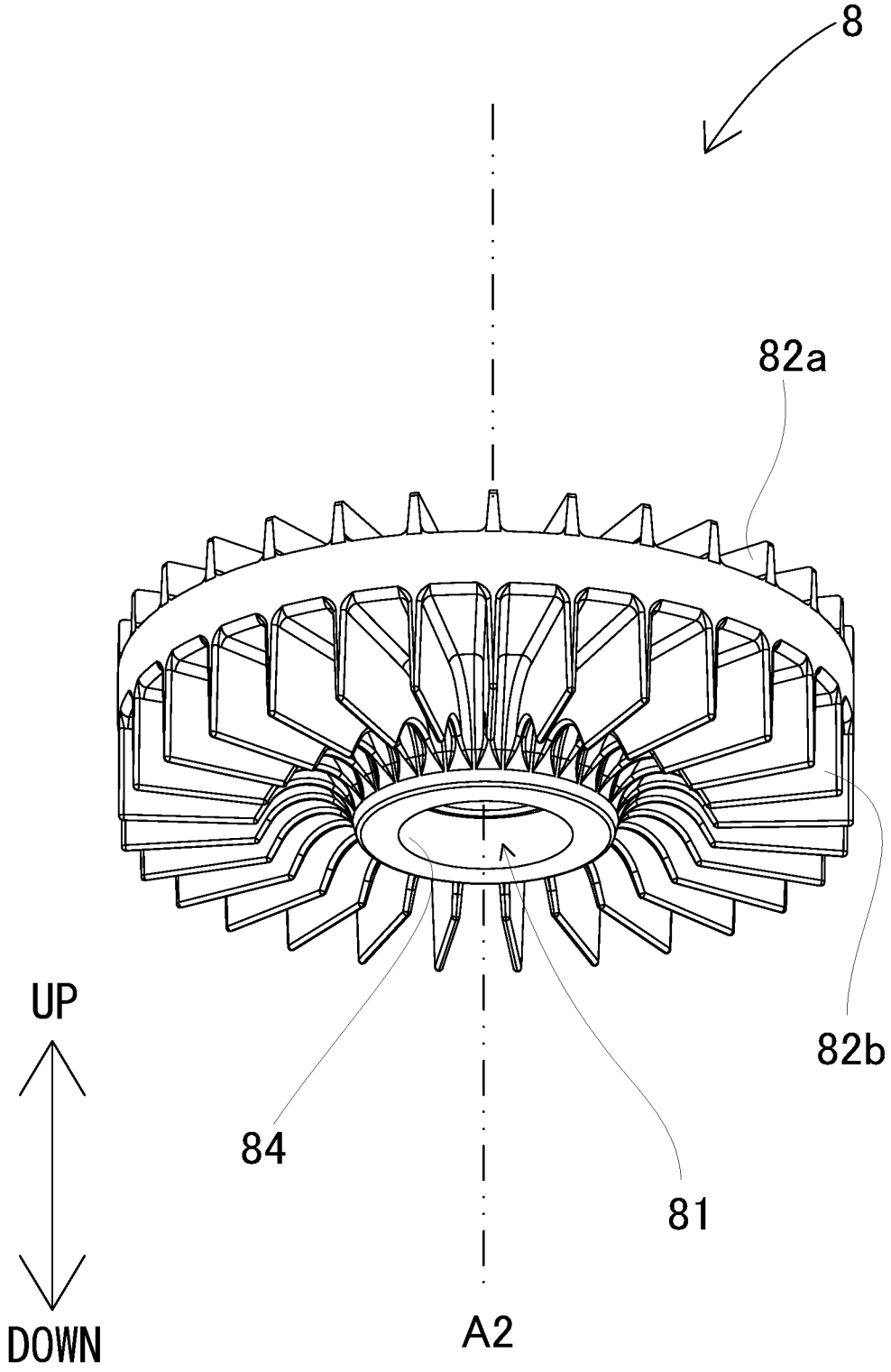
FIG. 8 is a perspective view of a cooling fan in a second embodiment of the present teachings.
Figure 9:
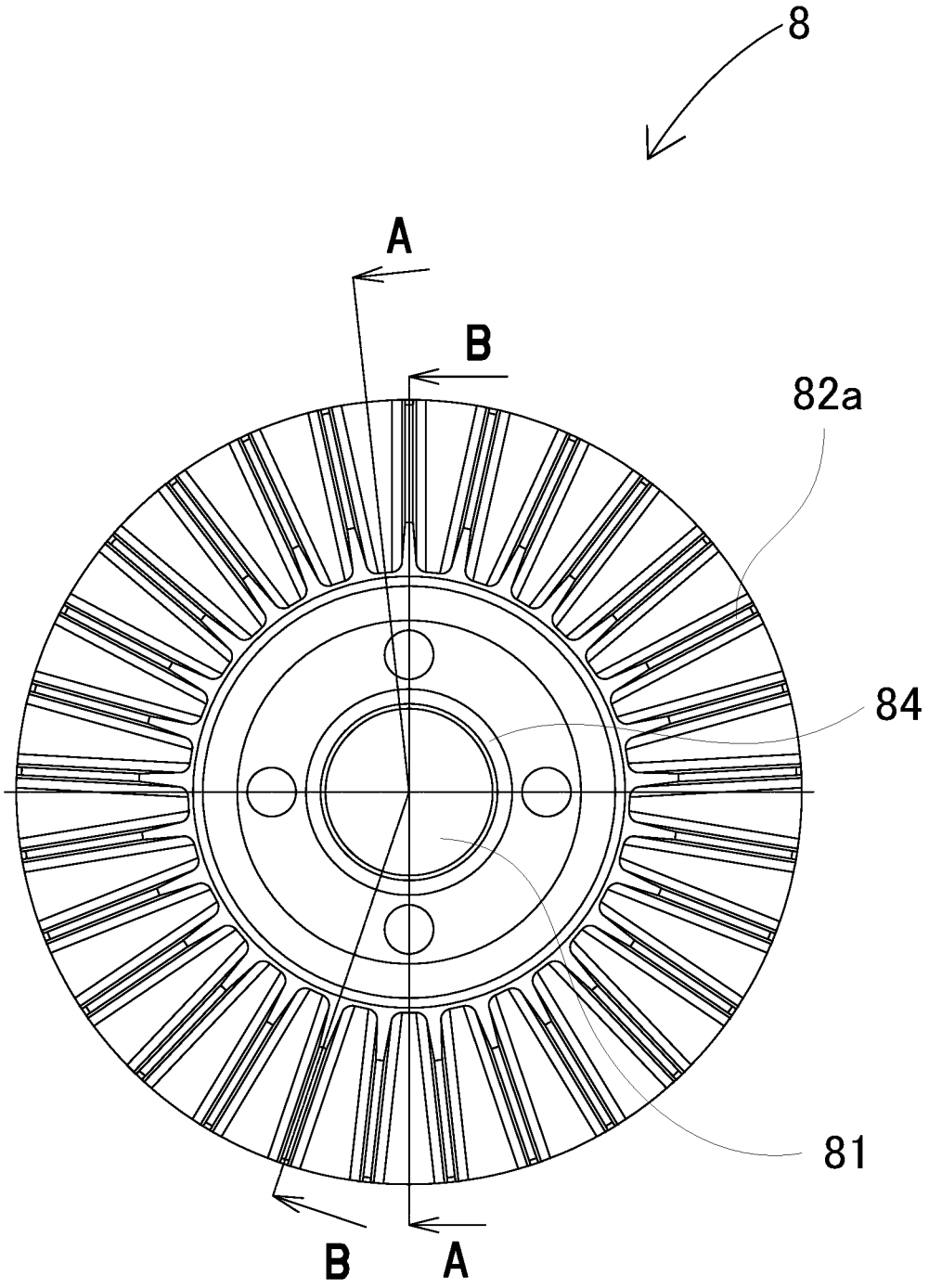
FIG. 9 is a top view of the cooling fan in the second embodiment.
Figure 10:
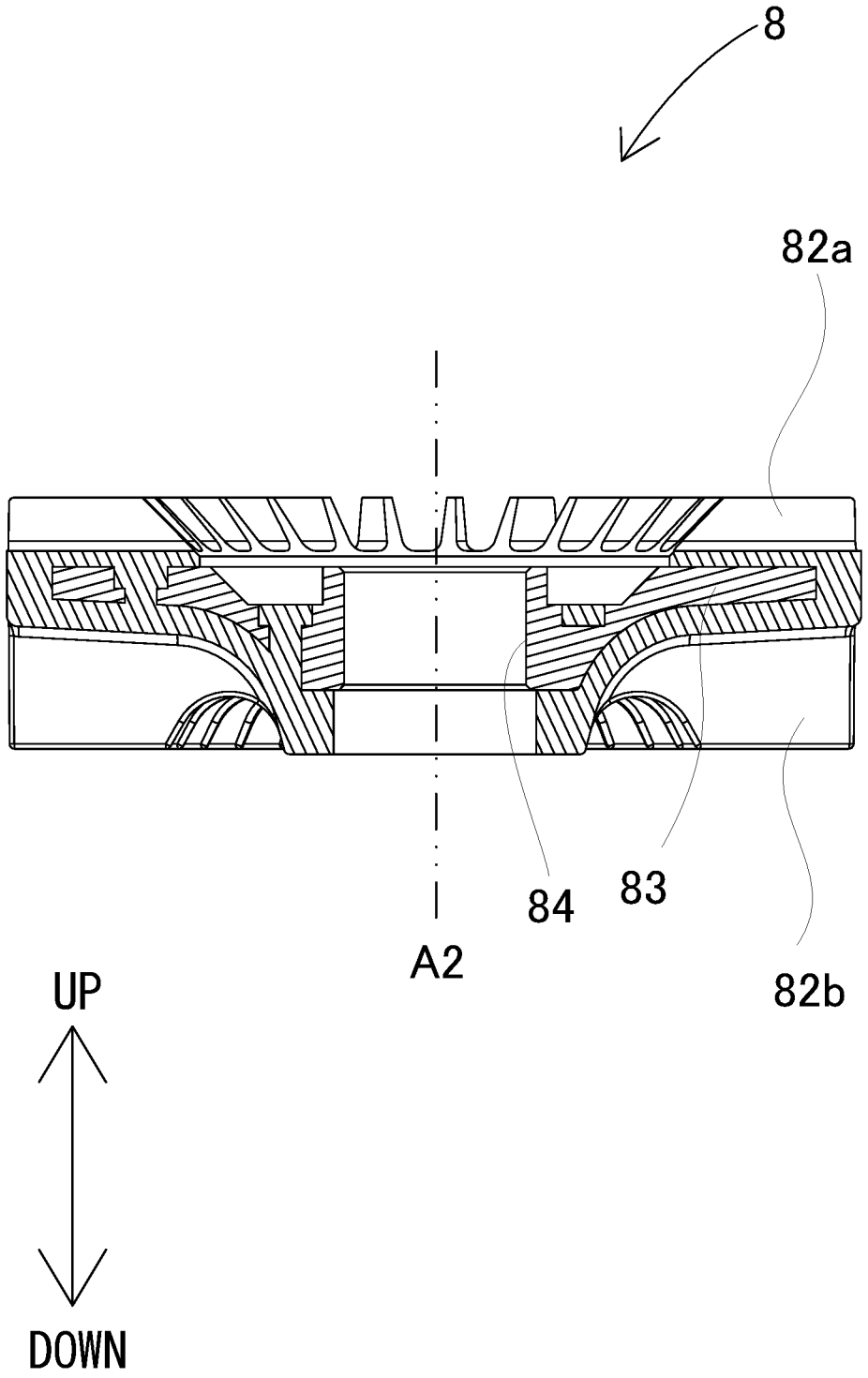
FIG. 10 is a sectional view taken along line A-A in FIG. 9.
Figure 11:
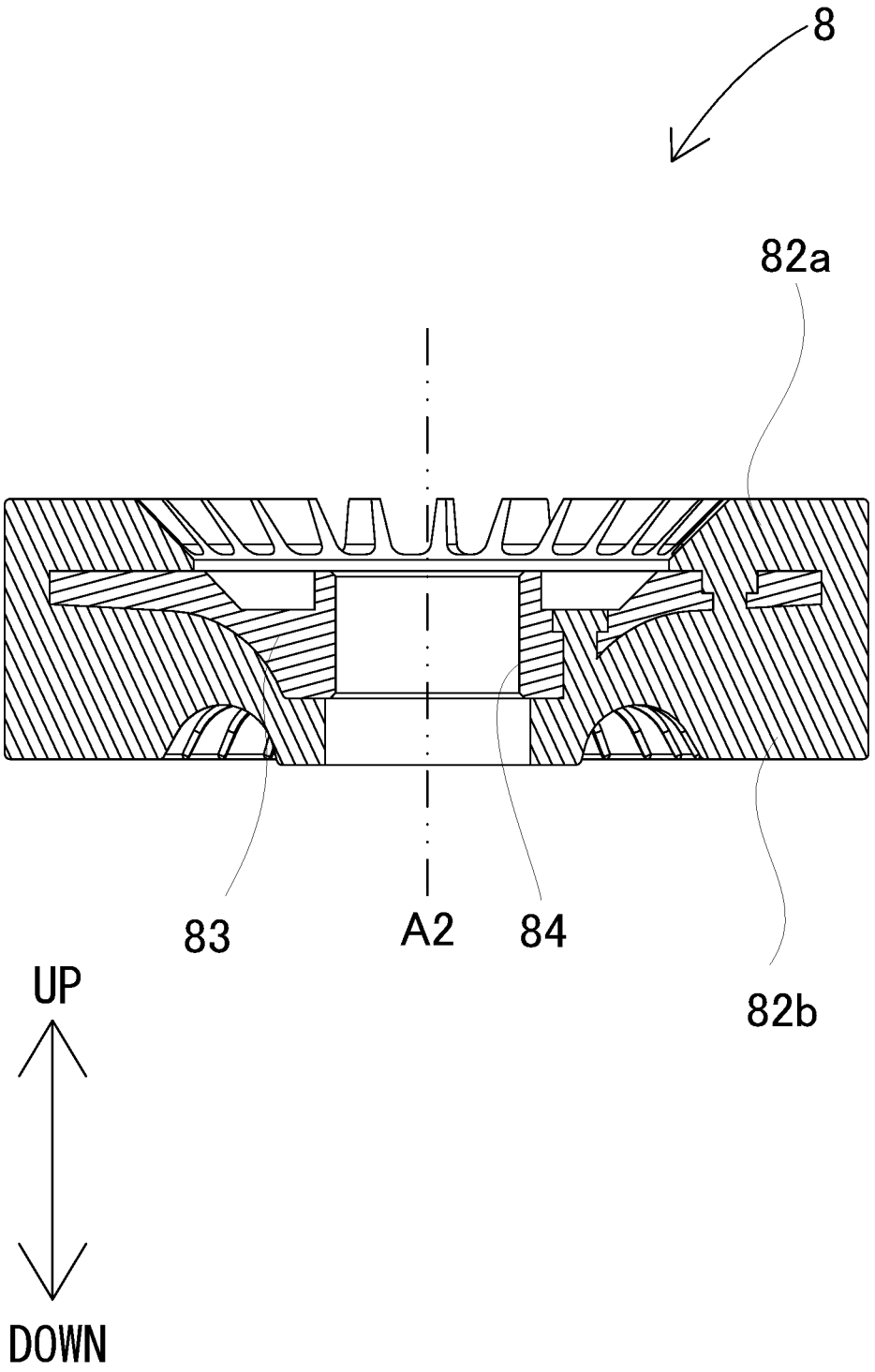
FIG. 11 is a sectional view taken along line B-B in FIG. 9.

As shown in FIGS. 3 and 4, the rotational axis A2 of the motor 2 coincides with the radial center of the cooling fan 7. The blade part 72 is arranged within a range between a second radius r2 and a fourth (outermost) radius r4 of the cooling fan 7 in the radial direction of the cooling fan 7. As was noted above, the weight 73 has an annular (ring-like) shape when viewed from (in) the rotational axis A2 direction (in a direction that is parallel to the rotational axis A2 or in the up-down direction). The weight 73 is arranged (disposed) within a range between a first radius r1 and a third radius r3 of the cooling fan 7 in the radial direction. The range between the first radius r1 and the third radius r3 overlaps the range between the second radius r2 and the fourth radius r4 when viewed from (in) the rotational axis A2 direction (the up-down direction, i.e. in plan view). Thus, the weight 73 (i.e., the metal member) is arranged such that the weight 73 at least partially overlaps the blade part 72 in the radial direction of the cooling fan 7, when viewed from (in) the rotational axis A2 direction (the up-down direction). More specifically, an inner contour or periphery (first radius r1) of the ring-like weight 73 in the radial direction of the cooling fan 7 is located radially inward of the radially inner edge or periphery (second radius r2) of the blade part 72 in the radial direction of the cooling fan 7. An outer contour periphery (third radius r3) of the ring-like weight 73 in the radial direction of the cooling fan 7 is located radially inward of the radially outer edge or periphery (fourth radius r4) of the blade part 72 in the radial direction of the cooling fan 7. Thus, the metal weight 73 extends to a relatively outer region of the cooling fan 7 in the radial direction. Provision of the weight 73 in this manner has the effect of increasing the moment of inertia of the cooling fan 7, i.e. as compared to a cooling fan formed exclusively of the polymer blade part 72 or a cooling fan having a metal member that is disposed only close to the rotational axis A2.

Further, the metal weight 73 is arranged at least in a region that extends radially outward of one-half of the fourth (maximum) radius (r4) of the cooling fan 7 (i.e. the metal weight 73 is at least partially disposed in a radially outer half of the cooling fan 7), when viewed from (in) the rotational axis A2 direction. Thus, by providing the metal weight 73 in this manner, it more effectively increases the moment of inertia of the cooling fan 7, as compared with a structure in which a weight 73 having the same mass is arranged entirely within a region that is radially inward of one-half of the fourth (maximum) radius (r4) of the cooling fan 7 (i.e. a structure in which the weight 73 is entirely disposed in a radially inner half of the cooling fan 7).

In this embodiment, the cooling fan 7 preferably has an outer diameter (i.e. two times the fourth radius r4) of 80 mm or more. More preferably, the cooling fan 7 of this embodiment has an outer diameter of 90 mm. Because the cooling fan 7 has a relatively large diameter, the moment of inertia of the cooling fan 7 is further increased (as compared to cooling fans having smaller outer diameters).

Further, in this embodiment, the mass of the weight 73 (the metal member) of the cooling fan 7 is 15% or more of the total of (a) the mass of the rotary member 26 (i.e. the total (combined) mass of the rotor 23 and the motor shaft 25) and (b) the mass of the resin member of the cooling fan 7 for the reason that will be described below.

In addition, in this embodiment, the moment of inertia of a rotation part as a whole, which includes the rotary member 26 (i.e., the rotor 23 and the motor shaft 25) of the motor 2 and the cooling fan 7, is $1.6\times10^{-4}$ kg·m$^2$ or more for the reason that will be described below.

In this embodiment, the cooling fan 7 having the above-described structure is provided in the rotary hammer 101 that is relatively large and capable of outputting an impact energy of 9.0 J or more in the hammer mode for the reason that will be described below.

The effects and advantages of providing (adding) a weight (a metal member, which preferably functions as an integral flywheel) in (to) a cooling fan are now described.

FIG. 5 shows a table of results of calculations of the moments of inertia of rotation parts (i.e. the rotor, the motor shaft, and the cooling fan) for a variety of rotary hammers and electric hammers (e.g., demolition hammers (or "breakers") and power scrapers, hereinafter simply referred to as "hammers"), which are representative types of power tools having a hammer mechanism according to the present teachings. The moments of inertia of the rotation parts of the different rotary hammers in the hammer mode are shown across an upper row of the table, and the moments of inertia of the rotation parts of the different hammers are shown across a lower row of the table.

In FIG. 5, multiple types of rotary hammers and hammers are shown in ascending order of size from left to right. Specifically, among the rotary hammers shown in FIG. 5, Rotary Hammer HR1 is the smallest rotary hammer and Rotary Hammers HR7 are the largest rotary hammers. Among the hammers shown in FIG. 5, Hammer HM2 is the smallest hammer and Hammer HM10 is the largest hammer. In the table of FIG. 5, the rotary hammer 101 of the above-described first embodiment corresponds to Rotary Hammer HR7 with the added weight. It is noted that, in the present teachings, rotary hammers and hammers (e.g., demolition hammers) are both configured to generate the striking force using a piston and impact bolt (striker) arrangement and differ only in that rotary hammers are design to also execute a drilling mode (e.g., rotation-only action mode and/or a rotation with hammering action mode) performed by the rotation transmitting mechanism 38 whereas hammers do not include a rotation transmitting mechanism such that the tool accessory is only linearly reciprocally moved (without rotation).

In FIG. 5, each of the rotary hammers of the types that respectively correspond to the hammers is shown directly above the corresponding hammer, and the corresponding types of the rotary hammers and the hammers are approximately equal in size. For example, in FIG. 5, Rotary Hammer HR3 and Hammer HM3 are approximately equal in size.

The rows labelled "motor" in FIG. 5 indicate the type of the motor used in each of the types of the rotary hammers and the hammers. Brushed motors and brushless motors are denoted by BR and BL, respectively. In FIG. 5, in each set of experimental examples shown in columns that are connected to each other, the left one used a brushed motor BR and the right one(s) used a brushless motor BL. For example, Rotary Hammer HR2 used a brushed motor BR and Rotary Hammer HR3 used a brushless motor BL. Rotary Hammer HR2 and Rotary Hammer HR3 are approximately equal in size. As another example, Hammer HM4 and Hammer HM5 are approximately equal in size, and differ from each other in that Hammer HM4 used a brushed motor BR whereas Hammer HM5 used a brushless motor BL.

In the experimental examples that used a brushed motor BR, a brushed motor having an optimal size for each type was used. In the experimental examples that used a brushless motor BL, two kinds of brushless motors, which are different in size, were used. Specifically, a brushless motor BLtype1 and a brushless motor BLtype2 were used. The length of a rotor in the rotational axis A2 direction (the overall length of magnets disposed in the rotor) of the brushless motor BLtype2 is double the length of the rotor of the brushless motor BLtype1. These brushless motors have the same diameter.

The rows labelled "weight" in FIG. 5 indicate whether or not a weight (a metal member) was included in (added to) the cooling fan of each experimental example. Specifically, the word "added" is indicated when the cooling fan included a weight (a metal member), while the word "none" is indicated when the cooling fan did not include a weight (a metal member).

The rows labelled "moment of inertia" in FIG. 5 indicate the value of the combined (total) moment of inertia of the rotor, the motor shaft and the cooling fan for each experimental example. As shown in FIG. 5, for both Rotary Hammer HR3 and Hammer HM3, a brushless motor BLtype1 was used to calculate the value of the moment of inertia. Thus, for both Rotary Hammer HR3 and Hammer HM3, the values of the combined (total) moments of inertia of the rotor and the motor shaft of the brushless motor BLtype1 and of the cooling fan are indicated in the respective rows.

For both Rotary Hammer HR5 and Hammer HM5, the value of the combined (total) moment of inertia was calculated for two different experimental examples (embodiments or configurations). In the first experimental example, a brushless motor BLtype1 was used to calculate the value of the moment of inertia, and in the second experimental example, a brushless motor BLtype2 was used to calculate the value of the moment of inertia. In the experimental examples that used the brushless motor BLtype2, the value of the moment of inertia is calculated only for the case "none", i.e. the cooling fan did not include a weight (metal member) for the reason that will be described below.

For each of Rotary Hammer HR7, Hammer HM7 and Hammer HM9, a brushless motor BLtype2 was used to calculate the value of the moment of inertia.

The rows labelled "impact energy" in FIG. 5 indicate the value of the impact energy that is required for each experimental example and that was confirmed by actual measurement as being the amount of the impact energy that the experimental example (type of power tool) is capable of outputting.

The rows labelled "fan diameter" in FIG. 5 indicate the diameter of the cooling fan used in each experimental example.

The rows labelled "mass of cooling fan" in FIG. 5 indicate the mass of the cooling fan used in each experimental example. The mass of a weight (metal member) provided in or on the cooling fan is shown in parenthesis. For example, for Rotary Hammer HR7 that includes a weight in (on) the cooling fan, the total mass of the cooling fan (i.e. including both the resin member and the metal member (weight)) is 140.3 g, whereas the mass of only the metal member (weight) of the cooling fan is 101.5 g.

The rows labelled "mass of rotary member" in FIG. 5 indicate the mass of the rotary member (i.e. the rotor and the motor shaft) used in each experimental example.

Results of comparison between the moment of inertia of each of the experimental example that used a brushed motor BR and the moment of inertia of its corresponding type that used a brushless motor BL are now described.

As can be seen from FIG. 5, for types of experimental examples (i.e. HR2 and HR3; HM2 and HM3) that require an impact energy of less than 9.0 J, the mass of the rotary member does not significantly differ between (each adjacent pair of) the experimental example that used a brushed motor (i.e. HR2 and HM2) and the experimental example that used a brushless motor (i.e. HR3 and HM3). Specifically, the mass of the rotary member of Rotary Hammer HR2 does not significantly differ from the mass of the rotary member of Rotary Hammer HR3. Similarly, the mass of the rotary member of Hammer HM2 does not significantly differ from the mass of the rotary member of Hammer HM3. Therefore, the moments of inertia did not significantly differ between the type of experimental example that used a brushed motor and the type of experimental example that used a brushless motor even though the type of experimental example that used the brushless motor did not have a weight (metal member) in the cooling fan. In other words, the moments of inertia did not significantly differ between the type of experimental example that used a brushed motor and the type of experimental example that used a brushless motor even though the mass of the type of experimental example that used the brushless motor was not increased. From the above comparison results, it is found that the average load current can be made substantially equal between the corresponding types (one using a brushed motor and the other using a brushless motor) when the required impact energy is outputted.

On the other hand, as shown in FIG. 5, for types of experimental examples that require an impact energy of 9.0 J or more, the mass of the rotary member significantly differs between (each adjacent set of) the type of experimental example that used a brushed motor and the type of experimental example that used a brushless motor.

For example, the mass of the rotary member of Rotary Hammer HR4 is 684 g, whereas the mass of the rotary member of Rotary Hammers HR5 that used a brushless motor BLtype1 is 346 g, which is considerably different from (less than) Rotary Hammer HR4. Further, the moments of inertia significantly differed between Rotary Hammer HR4 and Rotary Hammer HR5 that used a brushless motor BLtype1 and did not include a weight in the cooling fan. The moment of inertia of this Rotary Hammer HR5 is much smaller than the moment of inertia of Rotary Hammer HR4.

The moment of inertia of Rotary Hammer HR5 that used a brushless motor BLtype1 and included a weight in the cooling fan is close to the moment of inertia of Rotary Hammer HR4. From the above, for Rotary Hammers HR5 that used a brushless motor BLtype1, it is found that provision of a weight in (on) the cooling fan is useful to achieve an output of the required impact energy. The same applies to Hammer HM4 and Hammers HM5.

Further, the mass of the rotary member of Rotary Hammer HR5 using a brushless motor BLtype2 is 524 g, which is not significantly different from the mass of the rotary member of Rotary Hammer HR4. Therefore, in this case, Rotary Hammer HR5 does not need to include a weight in or on the cooling fan, which is the reason why the moment of inertia of Rotary Hammer HR5 that used a brushless motor BLtype2 is not calculated for the embodiment of Rotary Hammer HR5 that included a weight in the cooling fan.

As another example, the mass of the rotary member of Rotary Hammer HR6 is 920 g, whereas the mass of the rotary member of Rotary Hammer HR7 that used a brushless motor BLtype2 is 524 g, which is considerably different from that of (less than) Rotary Hammer HR6.

The required impact energy of the types of power tools exemplified by Rotary Hammer HR6 and Rotary Hammers HR7 is larger than the required impact energy of the types of power tools exemplified by Rotary Hammer HR4 and Rotary Hammers HR5. Thus, the required motor output of Rotary Hammers HR6, HR7 must be larger to achieve the higher required impact energy. For a brushed motor BR, the larger the required output, the larger the size and mass of the rotor will be, since the rotor of a brushed motor has a coil wound around it. That is, in order to increase the motor output of a brushed motor BR, the coil wound around the rotor must be increased in size (i.e. the number of windings must be increased). Therefore, the mass of the rotary member of the brushed motor BR used in Rotary Hammer HR6 is larger than the mass of the rotary member of the brushed motor BR used in Rotary Hammer HR4.

On the other hand, for a brushless motor BL, even if the required motor output is increased, the size and mass of the rotor do not significantly increase since the rotor of brushless motor contains permanent magnets, instead of a coil. Specifically, increasing the required motor output of a brushless motor BL is associated with a smaller percentage of increase of the size and mass of the rotary member of the brushless motor BL as compared to the percentage of increase of the size and mass of the rotary member of a brushed motor BR for an equivalent increase of the motor output.

For the above-described reasons, in the exemplary embodiment of Rotary Hammer HR7 that used a brushless motor BLtype2, the mass of the rotary member of this Rotary Hammer HR7 considerably differs from (is significantly less than) the mass of the rotary member of Rotary Hammer HR6. Consequently, the moment of inertia of the exemplary embodiment of Rotary Hammer HR7 that does not include a weight in or on the cooling fan considerably differs from (is significantly less than) the moment of inertia of Rotary Hammer HR6. That is, the moment of inertia of this exemplary embodiment of Rotary Hammer HR7 is much smaller than the moment of inertia of Rotary Hammer HR6.

On the other hand, the moment of inertia of the exemplary embodiment of Rotary Hammer HR7 that includes a weight in or on the cooling fan is close to the moment of inertia of Rotary Hammer HR6. From the above, it is found that provision of a weight in or on the cooling fan is useful for Rotary Hammers HR7. The same applies to the pair of Hammers HM6 and HM7 and the pair of Hammers HM8 and HM9.

As described above, for power tools requiring an impact energy of 9.0 J or more among the power tools (having a hammer mechanism) that use a brushless motor BL, in order to output the required impact energy, it is particularly useful to increase the moment of inertia by providing a weight (metal member) in or on the cooling fan.

Furthermore, owing to the provision of a weight in or on the cooling fan so the moment of inertia for the power tool is optimized, each of the power tools that used a brushless motor BL are capable of outputting the required impact energy at a reduced average load current during during a processing operation. Because the average load current is decreased for the same output, the run time of battery-driven power tools having a hammer mechanism can be increased owing to the power conservation resulting from adding a weight 73 to the cooling fan 7.

Referring to FIGS. 6 and 7, it is shown that, in exemplary embodiments that used a brushless motor, it is possible to reduce the average load current (without reducing the required (nominal) impact energy) by providing a weight in or on the cooling fan while optimizing the moment of inertia of the rotation part (i.e. the rotor, the motor shaft and the cooling fan).

In this regard, it is noted that some processing (hammering) operations using rotary hammers and hammers, such as chipping concrete, take an amount of time that is typically longer than operations performed by other power tools, such as, e.g., fastening operations performed by driver-drills. Therefore, the ratio of the amount of current consumption in the (relatively short) initial, run-up phase, in which the rotation part (i.e. the rotor, motor shaft and cooling fan) is accelerated to a particular (user set) target rotational speed, to the total amount of current consumption for the entire processing operation is small. After the rotation speed reaches the target rotational speed, the current is consumed to simply maintain the speed of the rotation part. Therefore, even though a rotation part that includes a weight (flywheel) will require more current to accelerate to the target rotational speed (as compared to a rotation part that does not include this extra weight (flywheel)), the overall (or average) current consumption will be less than a power tool having a rotation part that does not include this extra weight (flywheel), especially in processing operations that take a relatively long time (e.g., such as demolition operations).

FIG. 6 shows measured values of the average load current (based on the entire current consumed during a processing operation) of exemplary embodiments of Rotary Hammers HR7 that either have or do not have a weight in or on the cooling fan. To obtain these measurements, the four exemplary embodiments of Rotary Hammers HR7 were driven in the hammer mode. FIG. 7 shows measured values of the average load current (based on the entire current consumed during a processing operation) of exemplary embodiments of Hammer HM7 that either have or do not have a weight in or on the cooling fan. Each of the measured values shown in FIGS. 6 and 7 is the value of the average load current measured when the processing operation was performed while outputting the required impact energy. Further, in each of the measurements shown in FIGS. 6 and 7, the same pressing load was applied to a workpiece. In the measurement of the average load current for the exemplary embodiments in which the cooling fan included a weight, the moments of inertia were set to three prescribed values by adjusting (varying) the mass of the weight, and the average load current was measured at each of the values of the moment of inertia. To obtain these measurements, two kinds of tool accessories (tool accessory A and tool accessory B) were attached to Rotary Hammer HR7 and to Hammer HM7, and the average load current was measured for each of the cases in which the tool accessory A was attached and the cases in which the tool accessory B was attached.

As can be seen from these measurement results, in the exemplary embodiments in which the cooling fan included a weight, a larger moment of inertia could be obtained with a smaller average load current than in the exemplary embodiment in which the cooling fan did not include a weight. More specifically, in the measurements of Rotary Hammers HR7, for all of the three set values of the moment of inertia, the average load current was smaller when the cooling fan included a weight, regardless of whether the tool accessory A or the tool accessory B was attached thereto, than when the cooling weight did not include a weight. Similarly, in the measurements of Hammers HM7, for all of the three set values of the moment of inertia, the average load current was smaller when the cooling fan included a weight, regardless of whether the tool accessory A or the tool accessory B was attached thereto, than when the cooling fan did not include a weight. Furthermore, in the measurements of the embodiments of Rotary Hammers HR7 and Hammers HM7, in which the cooling fan included a weight, there was a value of the moment of inertia at which the average load current was minimized. Specifically, in the measurements of Rotary Hammers HR7, the average load current was minimized when a weight was provided in the cooling fan and adjusted such that the moment of inertia was $2.5\times10^{-4}$ $kg\cdot m^2$. Similarly, in the measurements of Hammers HM7, the average load current was minimized when a weight was provided in the cooling fan and adjusted such that the moment of inertia was $2.4\times10^{-4}$ $kg\cdot m^2$. Specifically, in cases in which the moment of inertia is adjusted by providing a weight in or on the cooling fan, there is an optimum value of the moment of inertia that minimizes the average load current. Thus, in power tools having a hammer mechanism, the average load current during processing of a workpiece can be effectively reduced by adjusting the mass of the weight that is added to the cooling fan such that the moment of inertia is optimized to minimize the average load current.

Therefore, by providing a weight (e.g., a flywheel integrated) in or on the cooling fan and optimizing the moment of inertia, it is possible to reduce the average load current of power tools that utilize a brushless motor while maintaining the required impact energy output. Further, as was explained above with reference to FIG. 5, for power tools that use a brushless motor and require an impact energy of 9.0 J or more, provision of a weight in or on the cooling fan is particularly effective to reduce the average load current.

Further, as can be seen from FIG. 5, for power tools that use a brushless motor and have such a size that requires a moment of inertia of $1.6\times10^{-4}$ kg·m$^2$ or more, provision of a weight (metal member) in or on the cooling fan is particularly useful to increase the moment of inertia. In other words, the moment of inertia considerably differs between the power tools that have such a size requiring a moment of inertia of $1.6\times10^{-4}$ kg·m$^2$ or more and that do not include a weight (metal member) in or on the cooling fan and an equal-sized power tools that use a brushed motor. Therefore, for power tools that use a brushless motor and have such a size that requires a moment of inertia of $1.6\times10^{-4}$ kg·m$^2$ or more, provision of a weight (metal member) in or on the cooling fan is particularly effective to increase the moment of inertia while suppressing an increase of the average load current (in fact, in some aspects of the present teachings, the average load current for achieving the same impact energy can actually be reduced).

Further, as can be seen from FIG. 5, in case the mass of the weight (metal member) in or on the cooling fan is 15% or more of the total of the mass of the rotary member and the mass of the resin member of the cooling fan, the moment of inertia of the rotary member and the cooling fan in a power tool (a rotary hammer or a hammer) having a hammer mechanism and driven by a brushless motor can be made equal to the moment of inertia of the rotor, the motor shaft and the cooling fan of a power tool (a rotary hammer or a hammer) having a hammer mechanism, having an equal size and driven by a brushed motor. For example, for Hammers HM5, the mass of the cooling fan is 114.6 g, and the mass of the weight in the cooling fan is 74.5 g. Thus, the mass of the resin member of the cooling fan is 40.1 g (114.6–74.5). The total of the mass (346 g) of the rotary member (BL-type1) and the mass (40.1 g) of the resin member of the cooling fan is 386.1 g (346+40.1). The mass (74.5 g) of the weight (metal member) in or on the cooling fan is more than 15% of the total (386.1 g) of the mass of the rotary member and the mass of the resin member of the cooling fan. In addition or in the alternative, it is preferable that the metal member (in particular, the mass of the metal member and the placement of the metal member) increases the moment of inertia of the rotation part (the rotor, the motor shaft and the cooling fan) by 20-70%, preferably by 45-55%, as compared to a rotation part having the same rotor, the same motor shaft and the same cooling fan but without the metal member.

Further, as shown in FIG. 5, for power tools that use a brushless motor BL and require an impact energy of 9.0 J or more, a cooling fan having a diameter of 80 mm or more is used. The moment of inertia is efficiently increased by utilizing a cooling fan having a relatively large diameter and having a weight added thereto. Specifically, by utilizing a cooling fan having a diameter of 80 mm or more, power tools having such a size efficiently increase the moment of inertia while maintaining a high cooling efficiency.

As described above, the rotary hammer 101 of the above-described first embodiment uses a brushless motor as the motor 2 to drive the tool accessory 18, so that the rotary hammer 101 has advantages of using a brushless motor. For example, compared with a rotary hammer that uses a brushed motor, the rotary hammer 101 of the first embodiment is configured such that the need for brush replacement is eliminated, the size and weight of the motor 2 are reduced and the energy conversion efficiency is increased. Further, in the first embodiment, the moment of inertia of the cooling fan 7 that includes the weight 73 (i.e., the metal member) is increased compared with a cooling fan that does not include such a metal member. Thus, the moment of inertia of the rotation part, which includes the rotary member (the rotor 23 and the motor shaft 25) and the cooling fan 7, is increased. Further, in the rotary hammer 101 of the first embodiment, the metal member at least partially overlaps the blade part 72 in the radial direction of the cooling fan 7, when viewed in the direction of the rotational axis of the cooling fan 7. Therefore, the moment of inertia of the cooling fan 7 is increased compared with a structure in which the metal member is arranged only around the rotational axis of the cooling fan (e.g., for the purpose of increasing the strength of the connection between the cooling fan and the motor shaft). As a result, the impact energy output of the rotary hammer 101 is increased. Thus, the rotary hammer 101 of the first embodiment has the advantages of using a brushless motor and can output the required impact energy while reducing the average load current (for the same impact energy) when the rotary hammer 101 is driven.

Further, the cooling fan 7 can be easily manufactured by integrally molding the resin member with the metal member, and the integrally molded cooling fan 7 has a sufficient strength.

Further, the connection part 74 of the cooling fan 7 that is connected with the motor shaft 25 is a portion of the metal member (i.e., the weight 73) and is connected to the motor shaft 25 by press-fitting the motor shaft 25 into the insertion hole 71 of the cooling fan 7. Therefore, the strength of the connection between the cooling fan 7 and the motor shaft 25 is increased owing to the press-fit, metal-to-metal contact (engagement).

The weight 73 (metal member) is at least partially disposed in the radially outer half of the cooling fan 7, when viewed in the rotational axis A2 direction of the cooling fan 7. Therefore, the moment of inertia of the cooling fan 7 is increased compared with a structure in which an entirety of a weight (metal member) having the same mass is arranged completely within the radially inner half of the cooling fan.

Further, the mass of the weight 73 (metal member) is 15% or more of the total of the mass of the rotary member 26 and the mass of the resin member of the cooling fan 7. Therefore, the moment of inertia of the rotary member 26 and the cooling fan 7 can be made approximately equal to the moment of inertia of the rotor, the motor shaft and the cooling fan of an equal-sized power tool having a hammer mechanism that is driven by a brushed motor.

Because the rotary hammer 101 of the first embodiment includes a cooling fun 7 having a diameter of 80 mm or more, the moment of inertia of the cooling fun 7 is increased while maintaining a high cooling efficiency.

Further, the cooling fan 7 has the blade part 72 on one side and the weight 73 (metal member) on the other side in the rotational axis A2 direction. This design simplifies the structure of the cooling fan 7 for manufacturing purposes.

In the description above, it is demonstrated that, for power tools that have a hammer mechanism and a brushless motor and that require the moment of inertia to be $1.6\times10^{-4}$ kg·m$^2$ or more, provision of a metal member in or on the cooling fan is particularly useful to increase the moment of inertia. In the rotary hammer 101 of the first embodiment, the moment of inertia of the rotation part (i.e. including the rotary member 26 of the blushless motor (the motor 2) and the cooling fan 7) is $1.6\times10^{-4}$ kg·m$^2$ or more. Therefore, the moment of inertia is effectively increased by providing the weight 73 in or on the cooling fan 7.

Further, in the description above, it is demonstrated that, for power tools that have a hammer mechanism and a brushless motor and that require an impact energy of 9.0 J or more, it is particularly useful to achieve the required impact energy to increase the moment of inertia by providing a metal member in or on the cooling fan. Because the rotary hammer 101 of the first embodiment is capable of outputting an impact energy of 9.0 J or more, the effect of increasing the moment of inertia by providing the weight 73 (metal member) in or on the cooling fan 7 is enhanced.

Further, as described above, because the moment of inertia is efficiently increased by providing the weight 73 (metal member) in or on the cooling fan 7, the average load current for outputting the same required impact energy is reduced. The rotary hammer 101 of the first embodiment has the battery mounting part 15 that is configured such that two rechargeable batteries 19 are removably mountable thereon, and the motor 2 (brushless motor) is driven using power from one or both of the batteries 19 mounted on the battery mounting part 15. Therefore, the run time of the rotary hammer 101 that is driven by power from the batteries 19 can be increased by providing the weight 73 in or on the cooling fan 7 owing to the reduced average load current that is needed to achieve the required impact energy.

In the rotary hammer 101 of the first embodiment, the direction in which the tool accessory 18 is driven crosses the direction of the rotational axis A2 of the motor 2 (brushless motor). This enables the components to be arranged inside the housing 10 in a more compact manner so that the overall size of the rotary hammer 101 can be reduced.

Second Embodiment

A second embodiment of the present disclosure differs from the first embodiment only with regard to the structure of the cooling fan. Therefore, only the different structure of the cooling fan will be described below, and all other aspects of the rotary hammer are identical to the first embodiment described above.

A cooling fan 8 of the second embodiment is now described with reference to FIGS. 8 to 11.

The cooling fan 8 has two blade parts respectively disposed on the two opposite sides (i.e., upper and lower sides) of the cooling fan 8 in the rotational axis A2 direction. Specifically, the cooling fan 8 has an upper blade part 82*a*, which has multiple blades, and a lower blade part 82*b*, which also has multiple blades. The upper and lower blade parts 82*a*, 82*b* are made of resin (polymer). In other words, the upper and lower blade parts 82*a*, 82*b* are portions of a resin member of the cooling fan 8. The cooling fan 8 further includes a weight 83, which is a metal member embedded in the cooling fan 8. That is, the weight 83 is disposed (interposed) between the upper and lower blade parts 82*a*, 82*b* in the up-down direction. In this second embodiment, the cooling fan 8 is formed by integrally molding (insert molding) the resin member with the metal member (i.e., the weight 83). Therefore, the cooling fan 8 can be easily manufactured.

Like in the first embodiment, a peripheral part (edge) of an insertion hole 81 of the cooling fan 8 is formed by a portion of the metal member (i.e., a portion of the weight 83). In other words, a connection part 84 of the cooling fan 8 for connection with the rotary member 26 (the motor shaft 25) is made of metal. Further, the cooling fan 8 is connected to the rotary member 26 by press-fitting the (metal) motor shaft 25 into the (metal) insertion hole 81 formed at (in) the radial center of the cooling fan 8. Therefore, because the insertion hole 81 is formed/defined by a metal part, the strength of the connection between the cooling fan 8 and the motor shaft 25 is increased by the metal-to-metal, press-fit contact.

Further, like in the first embodiment, the weight 83 (metal member) at least partially overlaps the upper and lower blade parts 82*a*, 82*b* in the radial direction of the cooling fan 8, when viewed in the rotational axis A2 direction (in a direction that is parallel to the rotation axis A2 or in the up-down direction). Provision of this weight 83 (metal member) in this manner increases the moment of inertia of the cooling fan 8.

Further, the metal weight 83 is at least partially disposed in a region outward of one-half of the radius of the cooling fan 8 (i.e. the metal weight 83 is at least partially disposed in a radially outer half of the cooling fan 8), when viewed in the rotational axis A2 direction. Therefore, the moment of inertia of the cooling fan 8 is further increased.

In addition, in this embodiment, the cooling fan 8 has a diameter of 80 mm or more. Therefore, the moment of inertia of the cooling fan 8 is increased.

Further, in this embodiment, the mass of the weight 83 (metal member) in the cooling fan 8 is 15% or more of the total of the mass of the rotary member 26 (i.e., including the rotor 23 and the motor shaft 25) and the mass of the resin member of the cooling fan 8.

In this embodiment, the moment of inertia of the rotation part (i.e., including the rotary member 26 (including the rotor 23 and the motor shaft 25) of the motor 2 and the cooling fan 8) is $1.6\times10^{-4}$ kg·m$^2$ or more. Further, in this embodiment, the cooling fan 8 having the above-described structure is provided in the rotary hammer 101 that is relatively large and capable of outputting an impact energy of 9.0 J or more in the hammer mode.

As described above, the rotary hammer 101 of the second embodiment includes the cooling fan 8 having the blade parts (upper and lower blade parts 82*a*, 82*b*) on both sides in the rotational axis A2 direction. Therefore, the airflow volume and the cooling efficiency of the cooling fan 8 are increased. Further, like in the first embodiment, the cooling fan 8 contains the weight 83, so that the same effects are obtained as in the first embodiment. Specifically, because the rotary hammer 101 of this second embodiment has an increased moment of inertia of the cooling fan 8 (as compared to a rotary hammer that does not include the weight 83 in the cooling fan 8), the impact energy can be increased while reducing the average load current required to achieve that impact energy (as compared to a rotary hammer that does not include the weight 83 in the cooling fan 7).

Correspondences between the features of the above-described embodiments and the features of the invention are as follows. The features of the above-described embodiments are merely exemplary and do not limit the features of the present disclosure. The rotary hammer 101, and the rotary hammers and the hammers in FIG. 5 are exemplary embodiments that correspond to the "power tool" that includes a hammer mechanism according to this disclosure. The tool accessory 18, and the tool accessories A, B in FIGS. 6 and 7 are exemplary embodiments that correspond to the "tool accessory" according to this disclosure. The cooling fans 7, 8 are exemplary embodiments that correspond to the "cooling fan" according to this disclosure. The blade part 72 is an exemplary embodiment that corresponds to the "first blade part" according to this disclosure. The upper and lower blade parts 82*a*, 82*b* are exemplary embodiments that correspond to the "first blade part" and "second blade part" according to this disclosure. The rotary member 26, which includes the rotor 23 and the motor shaft 25, is an exemplary embodiment that corresponds to the "rotary member" according to this disclosure. The weights 73, 83 are exemplary embodiments that correspond to the "metal member" according to this disclosure. The combination of the rotary member 26 (the rotor 23 and the motor shaft 25) and the cooling fan 7 as a whole is an exemplary embodiment that corresponds to the "rotation part" according to this disclosure. The battery mounting part 15 is an exemplary embodiment that corresponds to the "battery mounting part" according to this disclosure. The batteries (battery packs, battery cartridges) 19 are exemplary embodiments that correspond to the "battery" according to this disclosure.

The above-described embodiments are merely examples of the present teachings, and power tools having a hammer mechanism according to this disclosure are not limited to rotary hammers and hammers that are capable of linearly driving a tool accessory along a driving axis. It is possible to adapt the present teachings to any other type of power tool that utilizes a hammer mechanism and is configured to drive a tool accessory using the rotational force of a rotor and a motor shaft that rotate when a brushless motor is driven, and has a cooling fun that is rotated by this rotational force.

In the above-described embodiments, the cooling fans 7, 8 are configured to be directly connected to the motor shaft 25, but any other connecting/coupling structure may be utilized. For example, the cooling fan may be connected to the motor shaft 25 via a gear or one or more other connecting parts. In other words, the cooling fan may be rotated using the rotational force of the motor shaft 25 that is transmitted to the cooling fan via a gear or other connecting parts. Even with such a structure, the moment of inertia relating to the impact energy to be outputted by the power tool having a hammer mechanism is increased by providing a weight (metal member) in or on the cooling fan, so that the same effects as the above-described embodiments are obtained.

Further, in the above-described embodiments, various kinds of metal such as iron, copper, silver, lead, tin, stainless steel, brass, aluminum, tungsten and alloys containing one or more of these metals may be used to form the weight (metal member).

In the above-described embodiments, the weight (metal member) extends from a region inward of one-half of the radius (radially inner half) of the cooling fan to a region outward of one-half of the radius (i.e. the radially outer half) of the cooling fan, when viewed in the rotational axis direction of the cooling fan. However, the weight may be arranged only in the region outward of one-half of the radius (radially outer half) of the cooling fan. For example, the weight may be disposed along an outer peripheral edge of the cooling fan, which may enable the moment of inertia to be sufficiently increased at an overall lower mass of the cooling fan (i.e. with a lighter weight 83).

As an alternative configuration, the blade part of the cooling fan may be partially made of metal (i.e., formed by a portion of a metal member). The weight may be arranged on the positive pressure surface or the negative pressure surface of the blade part of the cooling fan. A plurality of weights (metal members) may be respectively disposed in a plurality of separate portions of the cooling fan. That is, the weight need not be continuous, but may be a plurality of discrete pieces, as long as the sum and distribution of the masses is rotationally balanced in the circumferential direction of the cooling fan.

Additional embodiments of the present teachings include, but are not limited to:

1. A power tool having a hammer mechanism and configured to drive a tool accessory, the power tool comprising:

a brushless motor that includes a rotary member having a rotor and a motor shaft and that is configured to drive the tool accessory by using a rotational force of the rotary member; and a cooling fan that has a first blade part and that is configured to be rotated by the rotational force of the rotary member, wherein:

the cooling fan includes a resin member and a metal member, the resin member includes at least a portion of the first blade part, and when viewed in a direction parallel to a rotational axis of the cooling fan, the metal member at least partially overlaps the first blade part in a radial direction of the cooling fan.

2. The power tool as defined in the above embodiment 1, wherein the mass of the metal member is 15% or more of the total of the mass of the rotary member and the mass of the resin member of the cooling fan.

3. The power tool as defined in the above embodiment 1 or 2, wherein the cooling fan is formed by integrally molding the resin member with the metal member.

4. The power tool as defined in any one of the above embodiments 1-3, wherein the metal member is at least partially arranged in a radially outer half of the cooling fan when viewed in (along) the direction of the rotational axis of the cooling fan.

5. The power tool as defined in any one of the above embodiments 1-4, wherein:

the cooling fan is connected to the motor shaft, a connection part of the cooling fan that is connected with the motor shaft is formed by a portion of the metal member, and the cooling fan is connected to the motor shaft by press-fitting the motor shaft into an insertion hole formed in the cooling fan.

6. The power tool as defined in any one of the above embodiments 1-5, wherein the cooling fan has a diameter of 80 mm or more.

7. The power tool as defined in any one of the above embodiments 1-6, wherein:

the first blade part is disposed on one side of the cooling fan in the direction parallel to the rotational axis of the cooling fan; and the metal member is disposed on the side of the cooling fan that is opposite to the first side in the direction parallel to the rotational axis direction.

8. The power tool as defined in any one of the above embodiments 1-6, wherein:

the cooling fan has a second blade part, the first blade part and the second blade part are respectively disposed on two opposite sides of the cooling fan in the direction parallel to the rotational axis of the cooling fan, and the metal member is disposed between the first and second blade parts in the direction parallel to the rotational axis.

9. The power tool as defined in any one of the above embodiments 1-8, wherein the moment of inertia of a rotary part that includes the rotary member of the brushless motor and the cooling fan is $1.6\times10^{-4}$ kg·m$^2$ or more.

10. The power tool as defined in any one of the above embodiments 1-9, wherein the power tool is configured to output an impact energy of 9.0 J or more.

11. The power tool as defined in any one of the above embodiments 1-10, wherein:

the power tool is configured to perform a processing operation on a workpiece by linearly driving the tool accessory, and a direction in which the tool accessory is driven crosses a direction of a rotational axis of the brushless motor.

12. The power tool as defined in any one of the above embodiments 1-11, further comprising:

a battery mounting part that is configured such that a rechargeable battery is removably mounted thereto, wherein the brushless motor is driven by using power that is supplied from the battery mounted to the battery mounting part.

13. The power tool as defined in any one of the above embodiments 1-12, wherein the mass of the metal member of the cooling fan is set such that a load current of the power tool is minimized when the power tool is driven in such a manner that a constant pressing load is applied to a workpiece.

14. The power tool as defined in any one of the above embodiments 1-13, wherein the moment of inertia of a (the) rotary part that includes the rotary member of the brushless motor and the cooling fan is set such that a load current of the power tool is minimized when the power tool is driven in such a manner that a constant pressing load is applied to a workpiece.

15. The power tool as defined in any one of the above embodiments 1-14, wherein:

the metal member has a ring-like shape when viewed in the direction parallel to the rotational axis of the cooling fan, an inner contour of the ring-like metal member in the radial direction of the cooling fan is located radially inward of an innermost side of a range of the first blade part in the radial direction of the cooling fan, and an outer contour of the ring-like metal member in the radial direction of the cooling fan is located radially inward of an outermost side of the range of the first blade part in the radial direction of the cooling fan.

Representative, non-limiting examples of the present invention were described above in detail with reference to the attached drawings. This detailed description is merely intended to teach a person of skill in the art further details for practicing preferred aspects of the present teachings and is not intended to limit the scope of the invention. Furthermore, each of the additional features and teachings disclosed above may be utilized separately or in conjunction with other features and teachings to provide improved power tools having a hammer mechanism.

Moreover, combinations of features and steps disclosed in the above detailed description may not be necessary to practice the invention in the broadest sense, and are instead taught merely to particularly describe representative examples of the invention. Furthermore, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

DESCRIPTION OF THE REFERENCE NUMERALS

2: motor, 3: driving mechanism, 4: mode switching dial, 5: controller, 6: lock mechanism, 7: cooling fan, 8: cooling fan, 10: housing, 11: first housing, 13: second housing, 14: trigger, 15: battery mounting part, 18: tool accessory, 19: battery, 21: stator, 23: rotor, 25: motor shaft, 26: rotary member, 28: driving gear, 30: motion converting member, 34: tool holder, 36: striking mechanism, 38: rotation transmitting mechanism, 39: clutch, 40: clutch switching mechanism, 41: operation part, 71: insertion hole, 72: blade part, 73: weight, 74: connection part, 81: insertion hole, 82*a*: upper blade part, 82*b*: lower blade part, 83: weight, 84: connection part, 101: rotary hammer, 111: driving mechanism housing part, 117: motor housing part, 131: grip part, 133: upper portion, 137: lower portion, 141: locking projection, 145: main switch, 171: elastic member, 175: elastic member, 731: through hole, A1: driving axis, A2: rotational axis, R: pivot axis, r1 to r4: radius, HR1 to HR7: rotary hammer, HM2 to HM10: hammer

What is claimed is:

1. A power tool comprising:

a hammer mechanism;

a brushless motor that includes a rotary member having a rotor and a motor shaft, the brushless motor being is configured such that the rotary member generates a rotational driving force for use in driving a tool accessory; and a cooling fan operably coupled to the rotary member and configured to be rotated thereby, the cooling fan having a first blade part, wherein:

the cooling fan includes a resin member and a metal member, the resin member forms at least a portion of the first blade part, when viewed in a direction parallel to a rotational axis of the cooling fan, the metal member at least partially overlaps the first blade part in a radial direction of the cooling fan, and the metal member has a mass that is 15% or more of a total combined mass of the rotary member and the resin member of the cooling fan.

2. The power tool as defined in claim 1, wherein the metal member is at least partially disposed in a radially outer half of the cooling fan.

3. The power tool as defined in claim 1, wherein:

the cooling fan is fixedly connected to the motor shaft, a connection part of the cooling fan that is fixedly connected with the motor shaft is formed by a portion of the metal member, and the motor shaft is press-fit in an insertion hole defined by the portion of the metal member.

4. The power tool as defined in claim 1, wherein the cooling fan has a diameter of 80 mm or more.

5. The power tool as defined in claim 1, wherein:

the first blade part is disposed on a first side of the cooling fan in the direction parallel to the rotational axis of the cooling fan; and the metal member is disposed on a second side of the cooling fan that is opposite to the first side in the direction parallel to the rotational axis direction.

6. The power tool as defined in claim 1, wherein:

the cooling fan has a second blade part, the first blade part and the second blade part are respectively disposed on opposite sides of the cooling fan in the direction parallel to the rotational axis of the cooling fan, and the metal member is interposed between the first blade part and the second blade part in the direction parallel to the rotational axis.

7. The power tool as defined in claim 1, wherein a rotation part that includes the rotary member of the brushless motor and the cooling fan has a moment of inertia of $1.6\times10^{-4}$ $kg\cdot m^2$ or more.

8. The power tool as defined in claim 1, wherein the power tool is configured to output an impact energy of 9.0 J or more.

9. The power tool as defined in claim 1, wherein:

the power tool is configured to perform a processing operation on a workpiece by linearly driving the tool accessory, and a direction in which the tool accessory is linearly driven crosses or is skewed with respect to a direction of a rotational axis of the brushless motor.

10. The power tool as defined in claim 1, further comprising:

a battery mounting part configured such that a rechargeable battery is removably mounted thereon, wherein the brushless motor is energized using power that is supplied from the battery mounted on the battery mounting part.

11. The power tool as defined in claim 1, wherein the mass of the metal member of the cooling fan is such that a load current of the power tool is minimized when the power tool is driven while a constant pressing load by the tool accessory is applied to a workpiece.

12. The power tool as defined in claim 1, wherein a rotation part that includes the rotary member of the brushless motor and the cooling fan has a moment of inertia such that a load current of the power tool is minimized when the power tool is driven while a constant pressing load is applied by the tool accessory to a workpiece.

13. The power tool as defined in claim 1, wherein:

the metal member is ring shaped when viewed in the direction parallel to the rotational axis of the cooling fan, an inner contour of the ring-shaped metal member of the cooling fan is located radially inward of an inner peripheral edge of the first blade part in a radial direction of the cooling fan, and an outer contour of the ring-like metal member of the cooling fan is located radially inward of an outer peripheral edge of the first blade part in the radial direction of the cooling fan.

14. The power tool as defined in claim 1, wherein the metal member of the cooling fan is integrally molded with or on the resin member.

15. A power tool comprising:

a hammer mechanism;

a brushless motor comprising a motor shaft that is rotatable around a rotational axis and is operably coupled to the hammer mechanism; and a cooling fan operably coupled to the motor shaft and configured to be rotated thereby, the cooling fan having blades, wherein:

the cooling fan comprises a polymer portion that forms at least a portion of the blades, a metal weight is disposed on or is at least partially embedded in the polymer portion, when viewed in a direction parallel to a rotational axis of the cooling fan, the metal weight at least partially overlaps the blades in a radial direction of the cooling fan that is perpendicular to the rotational axis, and the metal weight has a mass that is 15% or more of a total combined mass of the motor shaft, a rotor fixedly connected to the motor shaft and the polymer portion of the cooling fan.

16. The power tool according to claim 15, wherein:

the metal weight has an inner circular peripheral edge and an outer circular peripheral edge, the inner circular peripheral edge defines a through hole, a radius of the cooling fan in the radial direction is defined between the rotational axis and an outer peripheral edge of the cooling fan, and the outer circular peripheral edge of the metal weight is disposed between one-half of the radius of cooling fan in the radial direction and the outer peripheral edge of the cooling fan.

17. The power tool according to claim 16, wherein:

the inner circular peripheral edge of the metal weight is disposed radially inward of radially inward edges of the blades in the radial direction, and the motor shaft is press-fit in the through hole defined by the inner circular peripheral edge of the metal weight.

18. The power tool as defined in claim 17, wherein:

the metal weight is a continuous, annular piece of metal or a plurality of discrete pieces of metal that extend(s) along a circle around the rotational axis, the continuous piece of metal or each of the discrete pieces of metal has a width in the radial direction and a thickness in the direction of the rotational axis such that the width is at least two times the thickness, at least one through hole is defined in the continuous piece of metal or in each of the discrete pieces of metal between the inner circular peripheral edge and the outer circular peripheral edge, and the polymer portion fills the at least one through hole.

* * * * *